US006417437B2

(12) United States Patent
Aoki

(10) Patent No.: US 6,417,437 B2
(45) Date of Patent: Jul. 9, 2002

(54) AUTOMATIC MUSICAL COMPOSITION METHOD AND APPARATUS

(75) Inventor: Eiichiro Aoki, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/898,998

(22) Filed: Jul. 3, 2001

(30) Foreign Application Priority Data

Jul. 7, 2000 (JP) ..... 2000-207097

(51) Int. Cl.[7] ..... G10H 1/38; G10H 1/40

(52) U.S. Cl. ..... 84/611; 84/613; 84/651; 84/DIG. 12; 84/DIG. 22

(58) Field of Search ..... 84/609–614, 634–638, 84/649–652, 666–669, DIG. 12, DIG. 22

(56) References Cited

U.S. PATENT DOCUMENTS 5,214,993 A 6/1993 Konishi ..... 84/637
5,220,121 A 6/1993 Kawashima ..... 84/664

*Primary Examiner*—Stanley J. Witkowski
(74) *Attorney, Agent, or Firm*—Rossi & Associates

(57) ABSTRACT

In accordance with a rhythm of a main melody, a auxiliary-melody or counter-melody creating rhythm pattern is supplied which indicates timing of respective hit points of a plurality of tones in the auxiliary or counter melody. Predetermined important hit points and unimportant hit points in the supplied rhythm pattern are discriminated from each other. Any one of component notes of chords, specified by a previously-supplied chord progression, is allocated to each of the thus-discriminated important hit points, while any one of scale notes, corresponding to previously-supplied scale information, is allocated to each of the unimportant hit points. Thus, an auxiliary or counter melody is created on the basis of the notes allocated to the individual hit pints.

34 Claims, 10 Drawing Sheets

RHYTHM CHARACTERISTIC DATA OF MAIN MELODY

| RHYTHM PATTERN | NUMBER OF HIT POINTS | SYNCOPATION |
|---|---|---|
| M1 | SMALL | ABSENT |
| M2 | SMALL | ABSENT |
| M3 | MEDIUM | ABSENT |
| M4 | SMALL | ABSENT |
| M5 | GREAT | PRESENT |
| M6 | MEDIUM | ABSENT |

FIG. 9A

RHYTHM CHARACTERISTIC DATA OF COUNTER MELODY

| RHYTHM PATTERN | CORRESPONDING RHYTHM PATTERN OF MAIN MELODY | NUMBER OF HIT POINTS | SYNCOPATION |
|---|---|---|---|
| CM1 | M1, M4 | SMALL | ABSENT |
| CM2 | M2, M4 | SMALL | ABSENT |
| CM3 | M1, M3 | SMALL | ABSENT |
| CM4 | M2 | SMALL | ABSENT |
| CM5 | M1, M2 | MEDIUM | PRESENT |
| CM6 | M2 | MEDIUM | PRESENT |
| CM7 | M1, M4 | MEDIUM | PRESENT |
| CM8 | M4 | MEDIUM | PRESENT |

FIG. 9B

AUTOMATIC MUSICAL COMPOSITION METHOD AND APPARATUS

BACKGROUND OF THE INVENTION

The present invention relates to automatic musical composition methods and apparatus suitable for use, for example, in generating an auxiliary melody (duet, trio or the like), counter melody or like melody related to a main melody. More particularly, the present invention concerns a novel musical composition technique which permits generation of an auxiliary melody or counter melody rich in musical characteristics by, for example, detecting important hit points, such as downbeat hit points, from a rhythm pattern to be used for generating a main-melody-related melody and then imparting pitches of chord-component notes to the detected important hit points of the rhythm pattern and pitches of scale notes to unimportant hit points (other than the important hit points) of the rhythm pattern.

There have been known electronic musical instruments of a type having a function that, in response to manual performance of melody and chord parts on a keyboard, automatically imparts the performance with a duet part (one note added below a corresponding note the melody) or trio part (two notes added below a corresponding note of the melody).

Further, as an example of an automatic musical composition apparatus capable of composing a counter melody, there has been proposed one which is designed to detect chords and melody characteristics from a main melody and generate a counter melody in accordance with the detected chords and melody characteristics.

In the above-mentioned electronic music instrument, however, what is imparted to each melody note are one or more of a plurality of notes that compose a chord at the current time point, so that the tone generation of notes tend to be generated in an arpeggio-like style and thus would lead to an unsmooth melody. Namely, the conventional electronic music instrument is arranged to only select and impart chord-component notes to a real-time performance, rather than performing necessary processes after acquisition of necessary information of a whole music piece as in normal musical composition processes, and thus it could not produce a melody rich in musical characteristics which can be sung as in a real duet or trio.

Further, with the above-mentioned automatic musical composition apparatus, chords and melody characteristics can not be easily detected from an existing melody and thus it is difficult to create a counter melody which well suits or matches the main melody and is rich in musical characteristics.

SUMMARY OF THE INVENTION

In view of the foregoing, it is an object to provide a novel automatic musical composition method and apparatus which can automatically create an auxiliary melody or counter melody rich in musical characteristics.

It is another object to provide an automatic musical composition method and apparatus which can automatically generate a main melody as well as an auxiliary melody or counter melody.

According to one aspect of the present invention, there is provided an automatic musical composition method which comprises: a first step of supplying a rhythm pattern indicative of timing of respective hit points of a plurality of tones; a second step of discriminating between predetermined important hit points and unimportant hit points other than the important hit points in the rhythm pattern supplied by the first step; a third step of supplying at least a chord progression and scale information; and a fourth step of allocating, to each of the important hit points discriminated by the second step, any one of chord-component notes of chords specified by the chord progression supplied by the third step and allocating, to each of the unimportant hit points, any one of scale notes corresponding to the scale information. Here, a melody is created on the basis of the notes allocated to individual ones of the hit points by the fourth step.

According to another aspect of the present invention, there is provided an automatic musical composition method which comprises: a first step of supplying a first rhythm pattern indicative of timing of respective hit points of a plurality of tones for a first melody to be created and a second rhythm pattern indicative of timing of respective hit points of a plurality of tones for a second melody to be created; a second step of discriminating between predetermined important hit points and unimportant hit points other than the important hit points in the first rhythm pattern supplied by the first step, and discriminating between predetermined important hit points and unimportant hit points other than the important hit points in the second rhythm pattern supplied by the first step; a third step of supplying at least a chord progression and scale information; and a fourth step of allocating a note to each of the important hit points discriminated in the first rhythm pattern, taking into account at least chords specified by the chord progression supplied by the third step, and allocating, to each of the unimportant hit points in the first rhythm pattern, any one of scale notes corresponding to the scale information supplied by the third step; and a fifth step of allocating, to each of the important hit points discriminated in the second rhythm pattern by the second step, any one of the chord-component notes of the chords specified by the chord progression supplied by the third step, and allocating, to each of the unimportant hit points in the second rhythm pattern, any one of the scale notes corresponding to the scale information. Here, a first melody is created on the basis of the notes allocated to individual ones of the hit points by the fourth step, and a second melody is created on the basis of the notes allocated to individual ones of the hit points by the fifth step.

The present invention may be constructed and implemented not only as the method invention as discussed above but also as an apparatus invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its embodiments will be described in greater detail hereinbelow with reference to the accompanying drawings, in which:

FIGS. 9A and 9B are diagram showing an exemplary storage format in which rhythm characteristic data of a main melody and rhythm characteristic data of a counter melody are stored;

DETAILED DESCRIPTION OF EMBODIMENTS

One of the embodiments to be described hereinbelow is arranged to automatically create both of a first melody (e.g., main melody) and a second melody (e.g., auxiliary or counter melody). Another one of the embodiments to be described is arranged to automatically create only the second melody without creating the first melody. In either of the cases, a rhythm pattern suiting a rhythm of the first melody is provided as a rhythm pattern to be used for creating the second melody. Also, at least a chord progression and scale information is supplied. Then, discrimination is made between predetermined hit points and unimportant hit points other than the hit points in the second-melody creating rhythm pattern. Any one of chord-component notes of chords specified by the chord progression is allocated to each of the important hit points of the second-melody creating rhythm pattern, while any one of scale notes corresponding to the scale information is allocated to each of the unimportant hit points. Thus, the second melody is created on the basis of the notes allocated to individual ones of the hit points. Consequently, the tone generation style of the automatically-created second melody can be significantly diversified without being undesirably limited to an arpeggio-like style as with the conventional techniques. As a result, the present invention can provide auxiliary or counter melodies rich in musical characteristics. Similar scheme can be used to automatically create the first melody (e.g., main melody).

Figure 1:
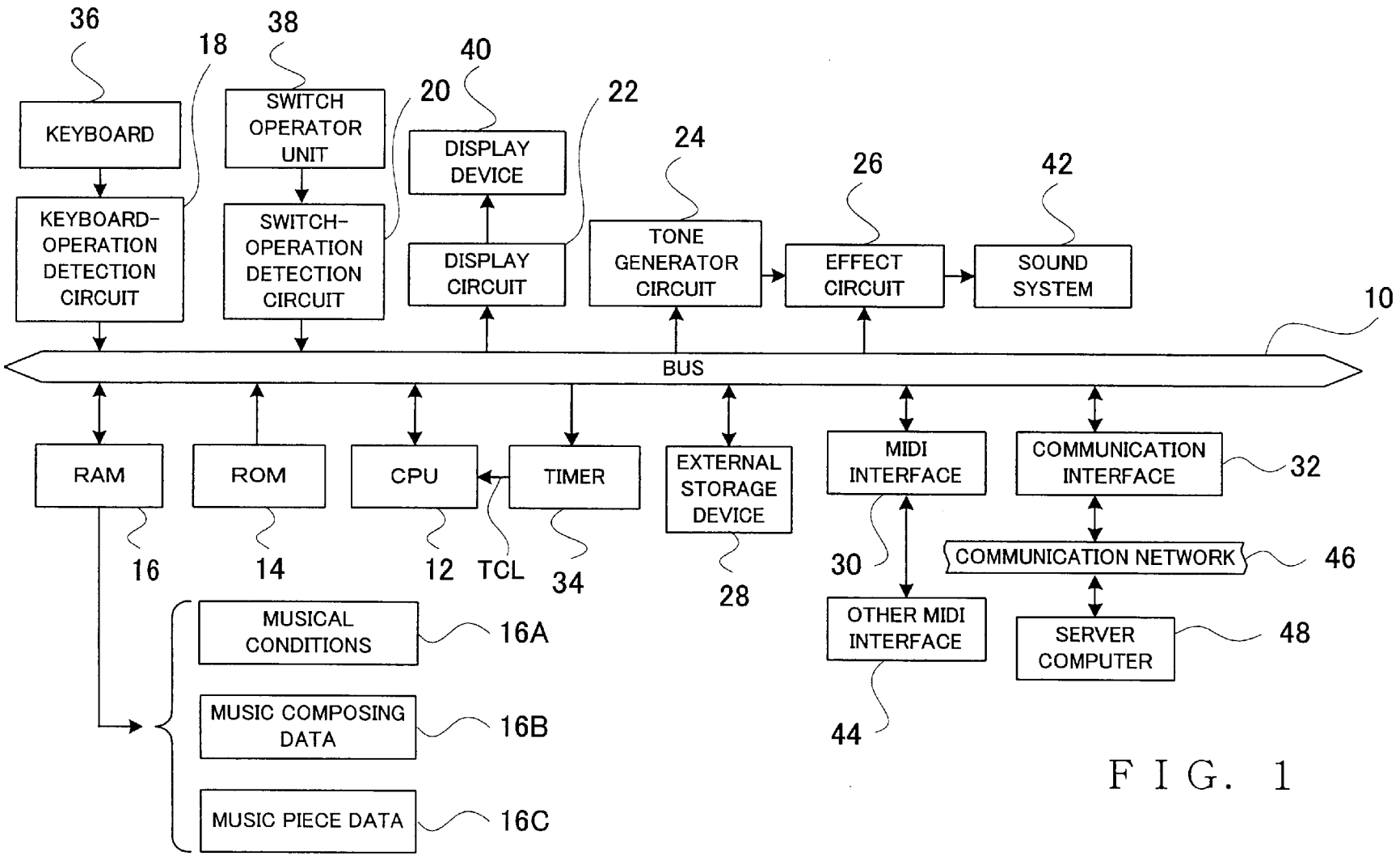
FIG. 1 is a block diagram showing an exemplary general setup of an electronic musical instrument equipped with an automatic musical composition apparatus in accordance with an embodiment of the present invention.

FIG. 1 is a block diagram showing an exemplary general setup of an electronic musical instrument equipped with an automatic musical composition apparatus in accordance with an embodiment of the present invention. Tone generation, music piece creation, etc. by this electronic musical instrument are controlled by a small-size computer such as a personal computer.

The electronic musical instrument of the invention includes a bus 10 to which are connected a CPU (Central Processing Unit) 12, a ROM (Read-Only Memory) 14, a RAM (Random-Access Memory) 16, a keyboard-operation detection circuit 18, a switch-operation detection circuit 20, a display circuit 22, a tone generator circuit 24, an effect circuit 26, an external storage device 28, a MIDI (Musical Instrument Digital Interface) interface 30, a communication interface 32, a timer 34, etc.

The CPU 12 carries out various processes for tone generation, music piece creation, etc., in accordance with software programs stored in the ROM 14. The music piece creation (musical composition) process will be later described in detail with reference to FIGS. 2 to 11. The RAM 16 includes various storage sections to be used in the various processes carried out by the CPU 12. Among the storage sections are a musical condition storage section 16A, music composing data storage section 16B and music piece data storage section 16C.

The keyboard-operation detection circuit 18 detects each operation on a keyboard 36 to generate keyboard operation information. The switch-operation detection circuit detects each operation on a switch operator unit 38 to generate switch operation information. The switch operator unit 38 comprises, for example, a keyboard with which a user can enter letters, numerical values, etc., and also includes a mouse. The display circuit 22 controls a display device 40 to provide for various visual displays.

The tone generator circuit 24 has a multiplicity of (e.g., 64) tone generating channels. Once a request for tone generation is made on the basis of key depression on the keyboard 36 or predetermined data readout from the music piece data storage section 16C, the CPU 12 assigns a tone generation instruction signal, tone pitch information and tone volume information, corresponding to the tone generation request, to any one of unoccupied or available tone generating channels. Then, the assigned tone generating channel generates a tone signal with a pitch corresponding to the tone pitch information and a volume corresponding to the tone volume information. Once a request for tone deadening or muting is made on the basis of key release on the keyboard 36 or predetermined data readout from the music piece data storage section 16C, the CPU 12 gives a tone deadening instruction signal to any one of the tone generating channels which is being generating a tone signal corresponding to tone pitch information related to the tone deadening request, so as to cause the tone generating channel to start attenuating the tone signal being generated thereby. In this way, the tone generator circuit 24 can generate manual performance tones and automatic performance tones.

The effect circuit 26 imparts various effects, such as chorus and reverberation effects, to the tone signals generated by the tone generator circuit 24. The tone signals output from the effect circuit 26 are then supplied to a sound system 42, via which the tone signals are audibly reproduced or sounded.

The external storage device 28 comprises one or more of removable (detachable) storage media, such as a hard disk (HD), floppy disk (FD), compact disk (CD), digital versatile disk (DVD) and magneto-optical disk (MD). With a desired one of such removable storage media installed in the external storage device 28, any desired data can be transferred from the storage medium to the RAM 1. If the storage medium installed in the external storage device 28 is a writable medium like the HD or FD, any desired data stored in the RAM 16 can be transferred to the installed storage medium in the storage device 28.

Any desired program may be prestored on the storage medium in the external storage device 28 rather than in the ROM 14, in which case the program stored on the storage medium can be transferred from the storage device 28 to be stored into the RAM 16, so that the CPU 12 is caused to operate in accordance with the program thus stored in the RAM 16. This arrangement can facilitate addition or version upgrade of a desired program.

The MIDI interface 30 is provided for communication of performance information between the electronic musical instrument and other MIDI equipment 44 such as an automatic performance apparatus. The communication interface 32 is provided for information communication between the electronic musical instrument and a server computer 48 via a communication network 46 (such as a LAN (Local Area Network), the internet and/or telephone line network). Any program and various data necessary for implementation of the present invention may be downloaded, in response to a download request, from the server computer 48 into the RAM 16 or external storage device 28 via the communication network 46 and communication interface 32.

The timer 34 generates tempo clock pulses TCL at a frequency corresponding to given tempo data TM, and each of the thus-generated tempo clock pulses TCL is supplied to the CPU 12 as an interrupt instruction. In response to each of the interrupt instructions from the timer 34, the CPU 12 executes an interrupt process. Using such an interrupt process, an automatic performance can be carried out on the basis of music piece data stored in the music piece data storage section 16C.

Figure 2:
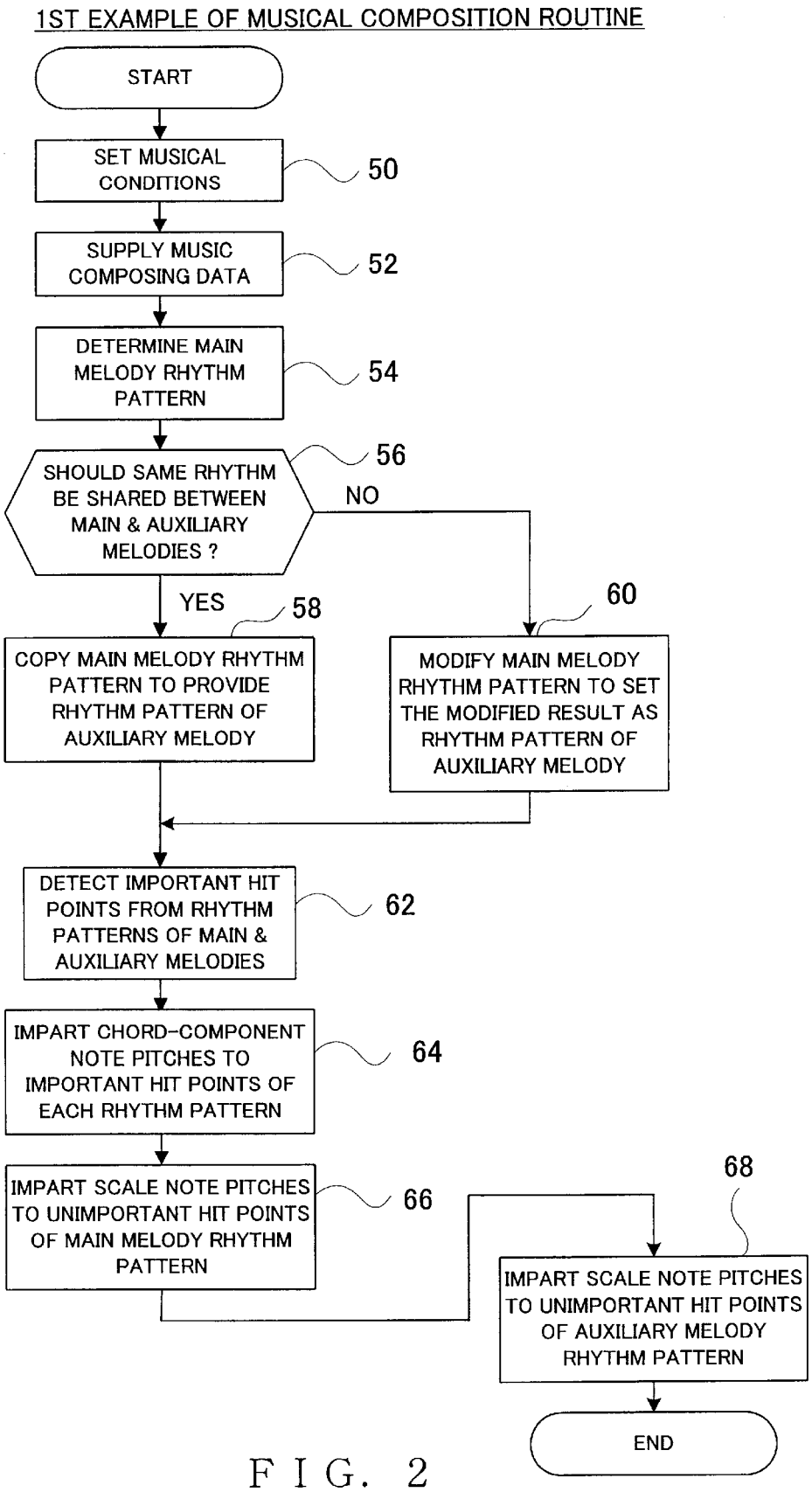
FIG. 2 is a flow chart showing a first example of a musical composition routine carried out in the embodiment of FIG. 1.

FIG. 2 is a flow chart showing a first example of a musical composition routine. At step 50, various musical conditions are set for a music piece to be created. As the musical conditions, data representative of a musical genre, musical key, musical time, tempo, musical phrase setup (sequence of the musical phrases and the number of measures per musical phrase), section or zone where an auxiliary melody is to be generated, whether or not a same rhythm (rhythm pattern) is to be shared between main and auxiliary melodies, whether pitches of the auxiliary melody should be higher or lower than those of the main melody, etc. are entered via the switch operator unit 38 and written into the musical condition storage section 16A.

Then, at step 52, music composing data are supplied which correspond to the musical conditions written in the musical condition storage section 16A. For example, the supply of the music composing data may be implemented in the following manner. Namely, as shown in FIG. 3, a plurality of rhythm characteristic templates (A), pitch characteristic templates (B) and chord progression templates (C) are prestored in a database provided in the ROM 14, external storage device 28 or the like, and respective ones of the rhythm characteristic templates, pitch characteristic templates and chord progression templates which correspond to the musical conditions are selectively read out and supplied from the database.

Figure 3:
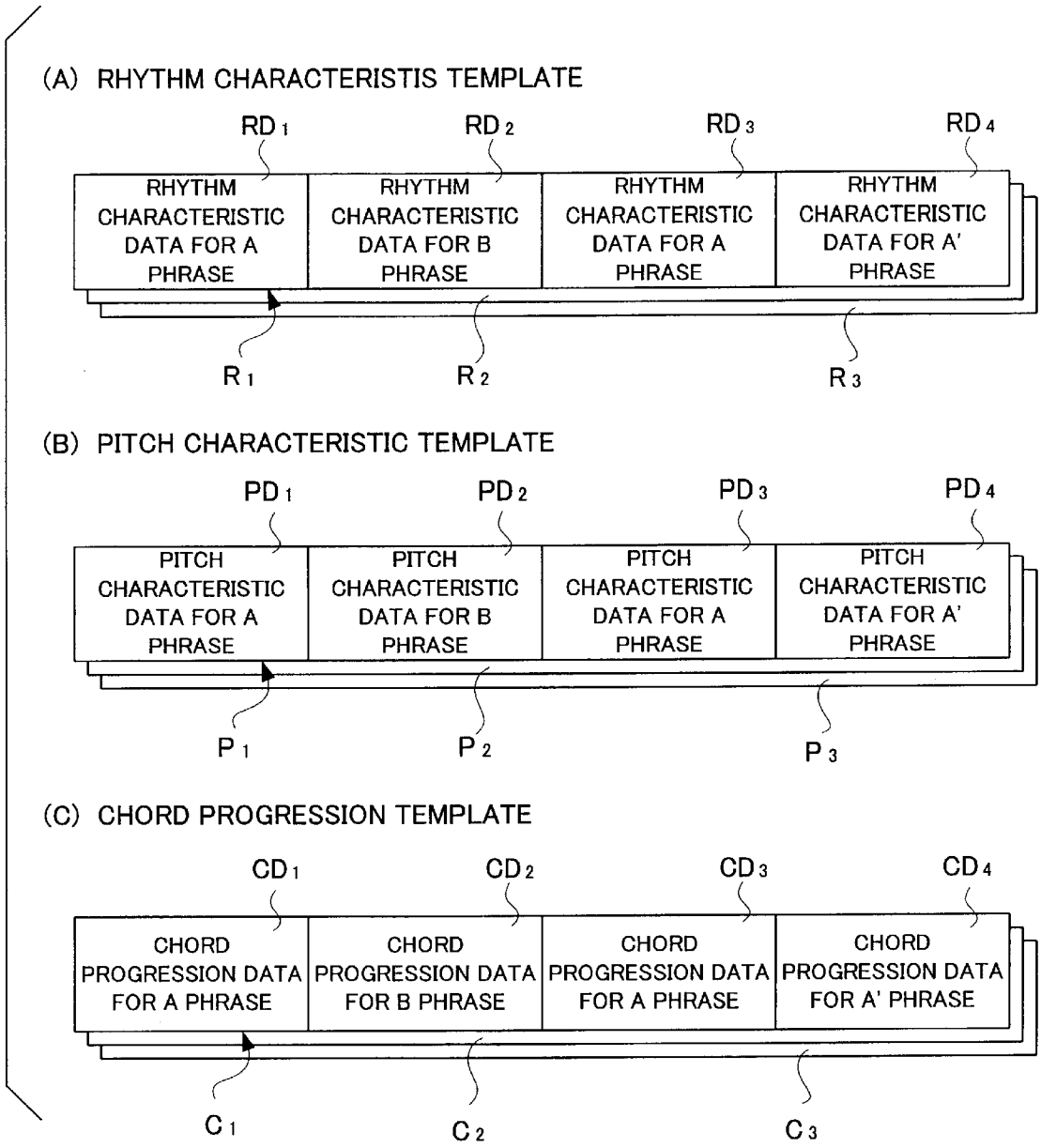
FIG. 3 is a diagram showing an exemplary storage format in which music composing data are stored in memory.

More specifically, in the above-mentioned database, there are prestored a plurality of the rhythm characteristic templates $R_1$, $R_2$, $R_3$, . . . which correspond to a plurality of musical phrase setups, as shown in section (A) of FIG. 3. As representatively shown in relation to the rhythm characteristic template $R_1$, each of the rhythm characteristic templates includes rhythm characteristic data for each musical phrase in accordance with a musical phrase sequence or arrangement, such as "A-type phrase—B-type phrase—A-type phrase—A'-type phrase", of the corresponding musical phrase setup. For instance, the rhythm characteristic template $R_1$ includes rhythm characteristic data $RD_1$–$RD_4$ corresponding to the musical phrases, "A-type phrase—B-type phrase—A-type phrase—A'-type phrase". For example, the rhythm characteristic data for each of the musical phrases represent rhythm-related characteristics of a main melody, such as presence/absence of syncopation, presence/absence of dotted note, whether the number of notes is small or great, density of the notes (e.g., sparse in a former half of a measure and dense in a latter half of the measure), etc. The phrase type marks, such as "A", "A'" and "B", represent identity or sameness, similarity and contrast of data between the musical phrases. For example, in the A-B-A-A' musical phrase sequence, the rhythm characteristic data in the leading A-type phrase are identical to the rhythm characteristic data in the subsequent A-type phrase and similar to the rhythm characteristic data in the last A'-type phrase. Further, the rhythm characteristic data in the B-type phrase represent rhythm characteristics contrastive to or different from those represented by the rhythm characteristic data in the A-type phrase.

Also, in the database, there are prestored a plurality of the pitch characteristic templates $P_1$, $P_2$, $P_3$, . . . which correspond to a plurality of musical phrase setups, as shown in section (B) of FIG. 3. Further, in the database, there are prestored a plurality of the chord progression data $C_1$, $C_2$, $C_3$, . . . which correspond to a plurality of musical phrase setups, as shown in section (C) of FIG. 3.

As representatively shown in relation to the pitch characteristic template $P_1$, each of the pitch characteristic templates includes pitch characteristic data for each musical phrase in accordance with a musical phrase sequence, such as "A-type phrase—B-type phrase—A-type phrase—A'-type phrase", of a corresponding musical phrase setup. For instance, the pitch characteristic template $P_1$ includes pitch characteristic data $PD_1$–$PD_4$ corresponding to the musical phrases, "A-type phrase—B-type phrase—A-type phrase—A'-type phrase". The pitch characteristic data for each of the musical phrases represent pitch characteristics of a main melody, such as extent of pitch leaps, pitches at important hit points (downbeat hit points, or, if no such hit points exist at downbeat positions, hit points near the downbeat positions), etc. As stated in relation to the rhythm template, the phrase type marks, such as "A", "A'" and "B", represent identity or sameness, similarity and contrast of data between the musical phrases.

As representatively shown in relation to the chord progression template $C_1$, each of the chord progression templates includes chord progression data for each musical phrase in accordance with a musical phrase sequence, such as "A-type phrase—B-type phrase—A-type phrase—A'-type phrase", of a corresponding musical phrase setup. For instance, the chord progression template $C_1$ includes chord progression data $CD_1$–$CD_4$ corresponding to the musical phrases, "A-type phrase—B-type phrase—A-type phrase—A'-type phrase". The chord progression data for each of the musical phrases represent a chord progression of a main melody. As stated in relation to the rhythm template, the phrase type marks, such as "A", "A'" and "B", represent identity or sameness, similarity and contrast of data between the musical phrases.

Referring back to FIG. 2, the rhythm characteristic template, pitch characteristic template and chord progression template of the same musical phrase setup as represented by the musical phrase setup data stored in the storage section 16A are selectively read out, at step 52, from among the templates $R_1$, $R_2$, $R_3$, . . . , $P_1$, $P_2$, $P_3$, . . . and $C_1$, $C_2$, $C_3$, . . . , and then written into the music composing data storage section 16B.

The rhythm characteristic templates, pitch characteristic templates and chord progression templates shown in section (A) to (C) of FIG. 3 may be stored in the database separately from each other, or these rhythm characteristic templates, pitch characteristic templates and chord progression templates may be stored in the database in sets that are grouped according to the musical phrase setup, i.e. in such a manner that the templates of a same musical phrase setup, such as "$R_1$, $P_1$, $C_1$", are stored together as a template set. In the case where the rhythm characteristic templates, pitch characteristic templates and chord progression templates are stored in the database on the set-by-set basis as mentioned above, the set of the rhythm characteristic template, pitch characteristic template and chord progression template of the same musical phrase setup as represented by the musical phrase setup data stored in the storage section 16A is read out together from the database and written into the music composing data storage section 16B.

In the database, a plurality of the rhythm characteristic templates, pitch characteristic templates and chord progression templates may be stored for each musical phrase setup. In this case, the plurality of the rhythm characteristic templates, pitch characteristic templates and chord progression templates are read out together on the basis of the musical phrase setup data stored in the storage section 16A, and the user may be allowed to select, for each of the template types, any one of the read-out templates, or, for each of the template types, a random selection may be made automatically of one of the read-out templates. In this way, the combination of the rhythm characteristic template, pitch characteristic template and chord progression template can be varied variously even with a same musical phrase setup, so that it is possible to significantly increase variations of a music piece to be created.

Whereas the instant embodiment has been described as reading out selected music composing data from the database, the user may set desired rhythm characteristics, pitch characteristics, chord progressions, etc. via the switch operator unit 38 as appropriate, and data indicative of the thus-set rhythm characteristics, pitch characteristics, chord progressions, etc. may be written into the music composing data storage section 16B.

Figure 4:
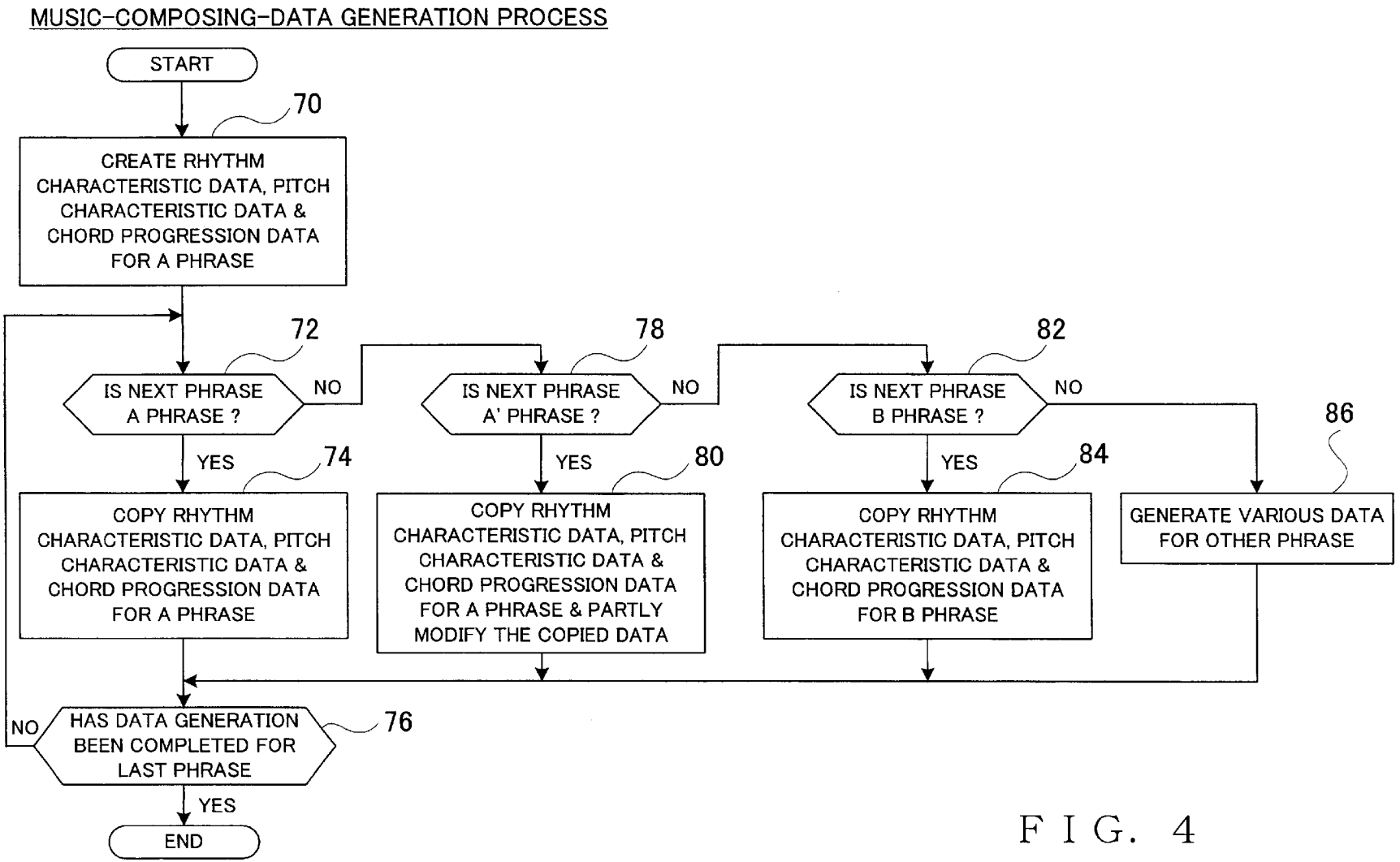
FIG. 4 is a flow chart showing a music-composing-data generation process carried out in the embodiment.

As another way of supplying the music composing data, a music-composing-data generation process of FIG. 4 may be used. Namely, at step 70, rhythm characteristic data, pitch characteristic data and chord progression data are generated for the leading or first A-type phrase for the main melody, and the thus-generated rhythm characteristic data, pitch characteristic data and chord progression data are written into a predetermined area of the RAM 16. These rhythm characteristic data, pitch characteristic data and chord progression data may be generated randomly, or several candidates of each of these data may be visually displayed on the display device 40 to allow the user to select one of the displayed candidates for each of the data. In the latter case, user's desire can be effectively reflected in the contents of the music piece to be created.

At next step 72 of FIG. 4, a determination is made as to whether the first musical phrase of the main melody is the A-type phrase or not, by referring to the musical phrase setup data stored in the musical condition storage section 16A. If answered in the affirmative (YES determination) at step 72, the music-composing-data generation process moves to step 74, where the rhythm characteristic data, pitch characteristic data and chord progression data for the A-type phrase are copied from the predetermined area of the RAM 16 into the music composing data storage section 16B. The music composing data storage section 16B includes first, second and third storage areas for storing the rhythm characteristic data, pitch characteristic data and chord progression data, respectively, and the rhythm characteristic data, pitch characteristic data and chord progression data for the A-type phrase from the predetermined area of the RAM 16 are copied into these first, second and third storage areas of the storage section 16B.

After step 74, the music-composing-data generation process proceeds to step 76, where it is determined whether or not data generation for the last musical phrase has been completed with reference to the musical phrase setup data stored in the musical condition storage section 16A. At a time point immediately after completion of the data generation for the first musical phrase, a negative (NO) determination is made at step 76, and thus the process loops back to step 72. Then, a determination is made at step 72 as to whether the next musical phrase is the A-type phrase or not, by referring to the musical phrase setup data stored in the musical condition storage section 16A. If answered in the negative (NO determination) at step 72, the process branches to step 78.

At step 78, a determination is made as to whether the next musical phrase (the same musical phrase as at step 72) is the A'-type phrase or not. With an affirmative determination at step 78, the process goes to step 80. At step 80, the rhythm characteristic data, pitch characteristic data and chord progression data for the A-type phrase are copied from the predetermined area of the RAM 16, then the thus-copied data are modified in part (e.g., in the respective latter half portions of these data), and then the resultant modified rhythm characteristic data, pitch characteristic data and chord progression data are written into the first, second and third storage areas, respectively, of the music composing data storage section 16B following the last-written rhythm characteristic data, pitch characteristic data and chord progression data.

After step 80, the process proceeds to step 76, where it is determined, similarly to the above-mentioned, whether or not data generation for the last musical phrase has been completed. If answered in the negative at step 76, the process reverts to step 72 in order to determine whether the next musical phrase is the A-type phrase or not. If answered in the negative at step 72, the process branches to step 78, where a determination is made as to whether the next musical phrase (the same musical phrase as tested at step 72) is the A'-type phrase or not. With a negative determination at step 78, the process goes to step 82 in order to determine whether the next musical phrase (the same musical phrase as tested at step 78) is the B-type phrase or not. If the next musical phrase is the B-type phrase as determined at step 82 (YES determination), the process moves on to step 84, where rhythm characteristic data, pitch characteristic data and chord progression data are generated for the B-type phrase and written into the first, second and third storage areas, respectively, of the music composing data storage section 16B in the same manner as set forth above. These rhythm characteristic data, pitch characteristic data and chord progression data may be generated randomly, or several candidates of each of these data may be visually displayed to allow the user to select one of the displayed candidates for each of the data.

After step 84, the process proceeds to step 76, where it is determined, similarly to the above-mentioned, whether or not data generation for the last musical phrase has been completed. If answered in the negative at step 76, the process reverts to step 72. When the next musical phrase is none of the A-, A'- and B-type phrases, a negative determination is made at each of steps 72, 78 and 78, so that the process branches to step 86.

At step 86, various data for another type of musical phrase are generated. Namely, if the next musical phrase is an A"-type phrase, the rhythm characteristic data, pitch characteristic data and chord progression data for the A-type or A'-type phrase are copied from the predetermined area of the RAM 16, then the thus-copied data are modified in part so as to be different those for the A'-type phrase, and then the resultant modified rhythm characteristic data, pitch characteristic data and chord progression data are written into the first, second and third storage areas, respectively, of the music composing data storage section 16B in a similar manner to the above-mentioned.

If the next musical phrase is a B'-type phrase, then the rhythm characteristic data, pitch characteristic data and chord progression data for the B-type phrase are copied from the predetermined area of the RAM 16, then the thus-copied data are modified in part, and then the resultant modified rhythm characteristic data, pitch characteristic data and chord progression data are written into the first, second and third storage areas, respectively, of the music composing data storage section 16B in a similar manner to the above-mentioned, at step 86.

If the next musical phrase is a C-type phrase, rhythm characteristic data, pitch characteristic data and chord progression data for the C-type phrase are generated and then written into the first, second and third storage areas, respectively, of the music composing data storage section 16B in a similar manner to step 84 above, at step 86.

After step 86, the process proceeds to step 76, where it is determined, similarly to the above-mentioned, whether or not data generation for the last musical phrase has been completed. Once the determination at step 76 has become affirmative, the music-composing-data generation process of FIG. 4 is brought to an end.

The music-composing-data generation process of FIG. 4 is arranged in such a manner that when the musical phrase setup data stored in the musical condition storage section 16A represent, for example, a musical phrase sequence of "A-type phrase—B-type phrase—A-type phrase—A-type phrase", rhythm characteristic data, pitch characteristic data and chord progression data corresponding to the "A-type phrase—B-type phrase—A-type phrase—A-type phrase" musical phrase sequence are stored into the first, second and third storage areas, respectively, of the music composing data storage section 16B.

Then, at step 54 of FIG. 2, a rhythm pattern for the main melody is determined in accordance with the rhythm characteristic data stored in the music composing data storage section 16B. An example of the rhythm pattern for the main melody is shown in section (A) of FIG. 11. The terms "rhythm pattern" as used herein refer to a train of notes to which no pitch is imparted and which comprises only information of tone generation timing and note lengths, and hence a tone generation timing pattern, as shown in section (A) of FIG. 11. Also note that the terms "hit point" as used herein refer to tone generation timing of each note in the train of notes.

At next step 56, on the basis of the data stored in the musical condition storage section 16A which is indicative of whether a same rhythm is to be shared between the main and auxiliary melodies, it is determined whether the main and auxiliary melodies should share a same rhythm. If answered in the affirmative at step 56, the rhythm pattern of the main melody, at step 58, is copied and determined as a rhythm pattern of the auxiliary melody. Note that when a zone where an auxiliary melody is to be generated has been designated at step 50 above, operations of steps 56 to 68 are carried out in such a manner that the auxiliary melody is generated only for the designated zone; otherwise, the auxiliary melody is generated for the whole of the music piece.

With a negative determination at step 56, the rhythm pattern of the main melody is modified so as to set the thus-modified rhythm pattern as a rhythm pattern of the auxiliary melody. In this case, the rhythm pattern of the auxiliary melody may be created, for example, by inserting or deleting unimportant hit points in or from the main melody with the important hit points of the main melody left unchanged. In the example of the rhythm pattern as shown in section (A) of FIG. 11, notes denoted with circled numerical values 1, 2, 3, . . . represent the important hit points, while notes with no such circled numerical values represent the unimportant hit points. In the case of a song, if it is desired to insert a hit point, no new hit point can be added because words are already fixed, so that the song is sung with one syllable prolonged; if, on the other hand, it is desired to delete a hit point, the song is sung without a long vowel of the words being prolonged.

Upon completion of the operation at step 58 or 60, the musical composition routine moves to step 62, where the important hit points are detected from the rhythm patterns of the main and auxiliary melodies. In the example of the rhythm pattern shown in section (A) of FIG. 11, notes denoted with circled numerical values 1, 2, 3, . . . represent the important hit points. In the illustrated example, first and third beats in a one-quarter time music piece are set and detected as the important hit points, although the important hit points may be set and detected in any other suitable manner.

At step 64, the important hit points detected from the rhythm pattern of the main melody are imparted with pitches in accordance with the pitch characteristic data and chord progression data stored in the music composing data storage section 16B. Also, the important hit points detected from the rhythm pattern of the auxiliary melody are imparted with pitches in accordance with the chord progression data stored in the music composing data storage section 16B.

In thus imparting pitches to the important hit points of the respective rhythm patterns of the main and auxiliary melodies, pitches of a plurality of chord-component notes may be imparted randomly to the important hit points of each chord zone (e.g., notes C, E and G in the case of the C major chord), with reference to the chord progression data stored in the music composing data storage section 16B. In this case, the following rules, for example, may be applied as first musical rules:

(a) a dominant motion should be made if considered as possible by reference to the chord progression;

(b) a same note must not occur more than twice in succession (successive occurrence of a same note up to two times is permitted);

(c) different pitches should be imparted between the main and auxiliary melodies; and (d) pitch intervals (differences) between the main and auxiliary melodies should be eight degrees (one octave) or below.

The musical rules at items (a) and (b) should be applied individually to the main and auxiliary melodies, while the rules at items (c) and (d) are applied when tone generation timing is the same for both of the main and auxiliary melodies.

When pitches are to be imparted to the rhythm pattern of the auxiliary melody, the pitches of the auxiliary melody are set to be either above or below the pitches of the main melody, with reference to the data stored in the musical condition storage section 16A which is indicative of whether pitches of the auxiliary melody should be higher or lower than those of the main melody. In the case of a duet, for example, the main and auxiliary melodies are set as upper and lower melodies, respectively, and pitches of fifth-degree and third-degree notes (or third-degree and first-degree notes) of chords are imparted to the important hit points of the upper and lower melodies, respectively.

Then, at step 66 of FIG. 2, pitches of scale notes are imparted randomly to the unimportant hit points in the rhythm pattern of the main melody. As the scale notes, there may be used a plurality of scale notes of the musical key (e.g., C major) indicated by the musical key data stored in the musical condition storage section 16A or a plurality of scale notes of an available note scale (AVNS). In the case where the available note scale is used, AVNS data indicative of the available note scale is used, for each chord, in the chord progression data as shown in section (C) of FIG. 3, and the pitch impartment is executed, for each chord zone, by referring to the AVNS data of the music composing data storage section 16B.

Figure 11:
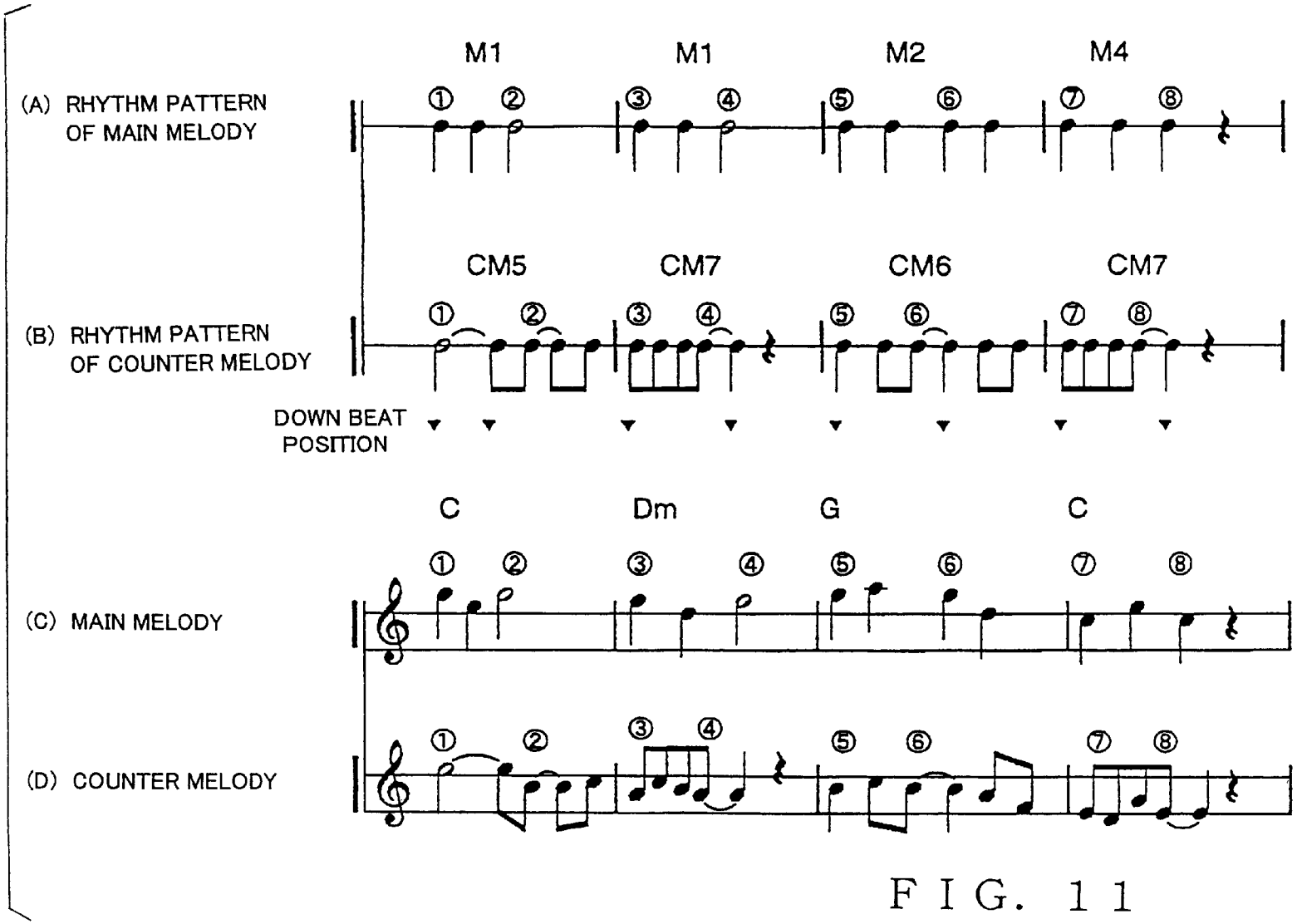
FIG. 11 is a diagram showing an example of a music piece created by the musical composition routine of FIG. 7.

When pitches are to be imparted to the unimportant hit points in the rhythm pattern of the main melody, a second musical rule is applied which is intended to limit the extent of pitch leaps to within predetermined degrees. The pitch leap extent may be determined with reference to the pitch characteristic data stored in the music composing data storage section 16B, or with reference to pitch leap extent data entered by the user at step 50. Section (C) of FIG. 11 shows an example of the rhythm pattern of the main melody where pitches are imparted to the important and unimportant hit points. Because the pitch impartment is carried out at steps 64 and 66 in accordance with the pitch characteristic data stored in the music composing data storage section 16B, the main melody is created in accordance with the musical phrase setup (e.g., "A—B—A—A'") specified by the pitch characteristic data.

Next, at step 68, scale note pitches are imparted randomly to the unimportant hit points in the rhythm pattern of the auxiliary melody, using scale notes of the musical key (e.g., C major) indicated by the musical key data or notes of an available note scale, in a similar manner to step 66 above. Because the main melody has already been created at step 66, there is a need to adjust relationship of the auxiliary melody with the main melody, the following rules are applied as third musical rules for that purpose:

(a) pitch intervals between the upper and lower melodies should be limited to within eight degrees; and (b) the upper and lower melodies should not intersect with each other —in this case, pitches of the main melody should never become lower than those of the auxiliary melody and pitches of the auxiliary melody should never become higher than those of the main melody. The auxiliary melody is created in accordance with the musical phrase setup (e.g., "A—B—A—A'") indicated by the musical phrase setup data stored in the musical condition storage section 16A, at steps 64 and 68.

Through the operations of steps 64 to 68 above, pitches are imparted to the important and unimportant hit points in the respective rhythm patterns of the main and auxiliary melodies. Thus, main and auxiliary melody data, indicative of the respective pitch-imparted rhythm patterns of the main and auxiliary melodies, are stored, as created music piece data, into the music piece data storage section 16C. After that, the musical composition routine of FIG. 2 is brought to an end.

Because pitches of the auxiliary melody, such as a duet or trio, are determined using scale notes as well as chord-component notes in the process of FIG. 2, the instant embodiment can significantly improve the musical characteristics of the auxiliary melody as compared to the conventionally-known techniques which determines pitches of auxiliary melodies using chord-component notes alone. Further, because the rhythm pattern of the auxiliary melody is set on the basis of the melody pattern of the main melody, satisfactory suitability of the auxiliary melody to the main melody is achieved.

Furthermore, because the instant embodiment creates an auxiliary melody only for a specific section or zone in the case where such a specific zone has been designated at step 50, it is possible to create a music piece of a high musical level, for example, by arranging the B-type phrase within the music piece as a duet phrase and/or arranging a second chorus (refrain) of the music piece as a trio phrase.

Furthermore, because the instant embodiment creates an auxiliary melody in accordance with given musical conditions, such as agreement/disagreement in rhythm between the main and auxiliary melodies and or upper/lower pitch relationship between the main and auxiliary melodies, in the case where such musical conditions have been set at step 50, user's desire can be effectively reflected in the contents of the auxiliary melody.

Note that although the routine of FIG. 2 has been described as not using the pitch characteristic data in imparting pitches to the important hit points in the rhythm pattern of the auxiliary melody, such pitch characteristic data may be used as in the case of the pitch impartment to the main melody rhythm pattern.

Figure 5:
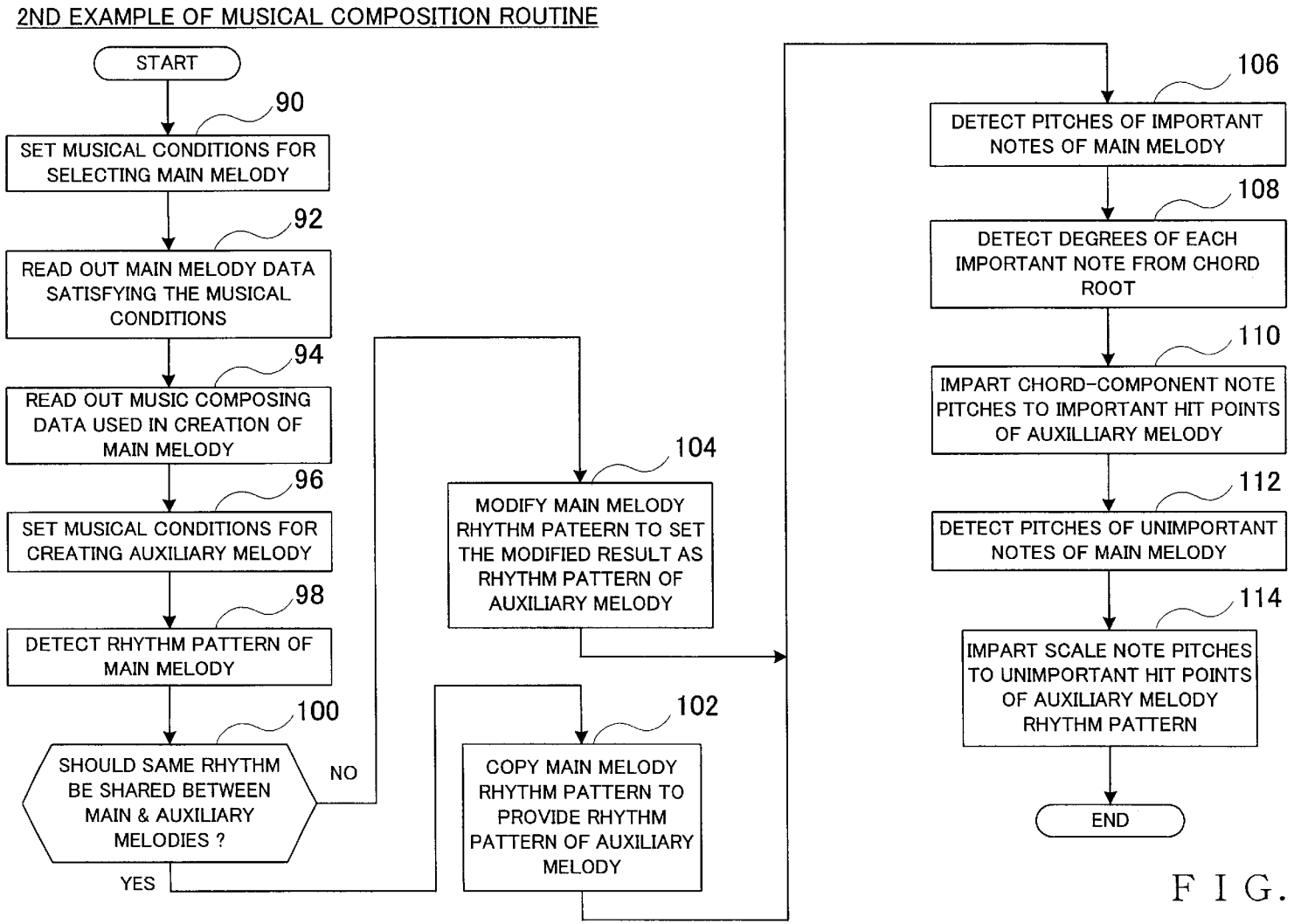
FIG. 5 is a flow chart showing a second example of the musical composition routine.

FIG. 5 is a flow chart showing a second example of the musical composition routine. In this example, an auxiliary melody is created which is well compatible with or appropriately suits the main melody having already been created. In this case, a plurality of main melodies have already been created by melody creation operations which are, for example, similar to those in the musical composition routine of FIG. 2 based on the music composing data read out from the database, and data representative of the thus-created main melodies have been stored in the database. In the database, there are stored the music composing data, having been used in the creation of the main melody, in the same manner as described earlier in relation to FIG. 3, and each of the chord progression data as shown in section (C) of FIG. 3 includes AVNS data for each chord.

At first step 90 of FIG. 9, musical conditions are set for selecting a main melody from among those stored in the database. As the musical conditions, data representative of a musical genre, musical key, musical time, tempo, setup of musical phrases, etc. are entered via the switch operator unit 38 and written into the musical condition storage section 16A. Then, the musical composition process of FIG. 5 moves on to step 92, where main melody data of any of the main melodies which satisfies the musical conditions set at step 90 are selectively read out from the database and then written into the music composing data storage section 16B. In case there are two or more main melodies satisfying the musical conditions, musical scores of these main melodies are visually displayed on the display device 40 or these main melodies are automatically performed for test listening such that the user can select a desired one of the main melodies satisfying the musical conditions.

Next, at step 94, the music composing data having been used for the creation of the selected main melody are read out from the database and written into the music composing data storage section 16B. Note that if the current time point is immediately after completion of the creation of the desired main melody, the operation of step 94 may be omitted because the music composing data used for the creation of the desired main melody are still present in the music composing data storage section 16B. In this case, the operations of steps 90 and 92 are replaced with an operation for transferring the main melody data from the music piece data storage section 16C to the music composing data storage section 16B.

At following step 96, musical conditions are set for creating an auxiliary melody. As such musical conditions, data indicative of a section or zone where the auxiliary melody is to be generated, whether or not a same rhythm is to be shared between the main and auxiliary melodies, whether pitches of the auxiliary melody should be higher or lower than those of the main melody, pitch range of the auxiliary melody, extent of pitch leaps in the auxiliary melody, etc. are entered via the switch operator unit 38 and written into the musical condition storage section 16A.

At step 98, a rhythm pattern (rhythm hit points) of the selected main melody are detected on the basis of the main melody data stored in the music composing data storage section 16B. After that, the process of FIG. 5 proceeds to step 100, where it is determined whether the main and auxiliary melodies should share a same rhythm, similarly to step 56 above. If answered in the affirmative (YES determination) at step 100, the rhythm pattern of the selected main melody, at step 102, is copied and determined as a rhythm pattern of the auxiliary melody. Note that when a particular zone where an auxiliary melody is to be generated has been designated at step 96 above, operations of steps 100 to 114 are carried out in such a manner that the auxiliary melody is generated only in the designated zone; otherwise, the auxiliary melody is generated for the whole of the music piece.

With a negative (NO) determination at step 100, the rhythm pattern of the selected main melody is modified so as to set the thus-modified rhythm pattern as a rhythm pattern of the auxiliary melody to be created, at step 104. The operation of step 104 may be carried out in a similar manner to step 60 above.

At next step 106, detection is made of pitches of the important notes (i.e., at the important hit points) of the main melody, on the basis of the main melody data stored in the music composing data storage section 16B. Then, the process of FIG. 5 goes to step 108, where degrees from a chord root are detected for each of the pitch-detected important notes. More specifically, at step 108, a chord root is detected for each of the chord zones with reference to the chord progression data stored in the music composing data storage section 16B, and the pitch of each of the important notes belonging to the chord zone in question is compared to the detected chord root. As an example, if the detected pitch of the important note is "G" and the corresponding detected chord root is "C", the pitch interval or difference of the pitch of the important note from the chord root is five degrees.

At step 110 following step 108, pitches of chord-component notes are imparted to the important hit points of the auxiliary melody rhythm pattern which correspond to the important notes of the main melody rhythm pattern. Namely, pitches of chord-component notes are imparted randomly, for each chord zone in the auxiliary melody rhythm pattern, to the important hit points belonging to the chord zone, with reference to the chord progression data stored in the music composing data storage section 16B. In this case, the following rules are applied as fourth musical rules:

(a) the auxiliary melody should be imparted with pitches different from those of the main melody; and (b) pitch intervals of the auxiliary melody from the main melody should be limited to within eight degrees. Also, the pitches of the auxiliary melody are set to be either above or below the pitches of the main melody, with reference to the data stored in the musical condition storage section 16A which is indicative of whether pitches of the auxiliary melody should be higher or lower than those of the main melody. As an example, where the main and auxiliary melodies are set as upper and lower melodies, respectively, and if the important note of the main melody detected at step 108 above is the fifth-degree note (note "G" in the C major chord), the pitch of one of the third- and first-degree notes is imparted to the important hit point of the auxiliary melody corresponding to the important note in accordance with item (a) of the fourth musical rules. In this case, which one of the third- and first-degree note pitches should be imparted may be determined randomly, or one of the third- and first-degree note pitches which is closer to the pitch of the immediately preceding important hit point may be selected for impartment to the important hit point of the auxiliary melody. In this case, the important hit point at the very beginning of the auxiliary melody may be set randomly to a certain pitch or set to a predetermined pitch.

At next step 112, detection is made of pitches at the unimportant notes (unimportant hit points) of the main melody, on the basis of the main melody data stored in the music composing data storage section 16B. Then, the process of FIG. 5 goes to step 114, where pitches of scale notes are imparted randomly to the unimportant hit points of the auxiliary melody rhythm pattern. As the scale notes, there may be used a plurality of notes constituting a scale indicated by the musical key data stored in the musical condition storage section 16A or a plurality of scale notes of an available note scale (AVNS) represented by the AVNS data stored in the music composing data storage section 16B. The pitch impartment is executed in such a manner the pitches of the auxiliary melody appropriately suits the pitches of the main melody detected at step 112 above, and the following rules are applied as fifth musical rules:

(a) the pitches should be caused to leap with reference to the data stored in the storage section 16A which is indicative of the pitch leap extent of the auxiliary melody;

(b) pitch intervals of the auxiliary melody from the main melody should be limited to within eight degrees; and (c) the upper and lower melodies should not intersect with each other. Here, in case the item (a) rule conflicts with the item (b) and item (c) rules, the item (b) and item (c) rules are given a higher priority over the item (a) rule. At steps 110 and 114, the auxiliary melody is created in accordance with the musical phrase setup (e.g., "A—B—A—A") indicated by the musical phrase setup data stored in the musical condition storage section 16A.

Auxiliary melody data, indicative of the rhythm pattern of the auxiliary melody where pitches have been imparted to the important and unimportant hit points in the above-mentioned manner, are stored into the music piece data storage section 16C. When the above-described auxiliary melody creation process has been executed immediately after completion of the creation of the main melody, the auxiliary melody data are stored into the music piece data storage section 16C along with the main melody data. After that, the musical composition routine of FIG. 5 is brought to an end.

The musical composition process of FIG. 5 affords the same advantageous results as stated earlier in relation to the musical composition routine of FIG. 2.

Figure 6:
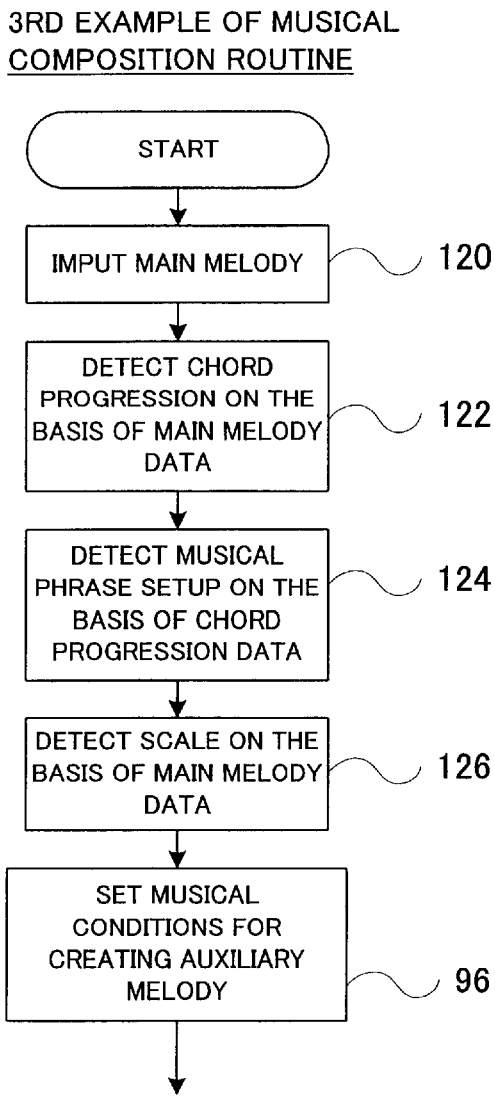
FIG. 6 is a flow chart showing a third example of the musical composition routine.

FIG. 6 is a flow chart showing a third example of the musical composition routine. In this example, a main melody is input in a desired manner, and an auxiliary melody is created which appropriately suits the input main melody. Namely, at step 120, a main melody is input by the user actually executing a manual performance on the keyboard 36, or is input as MIDI performance data via the MIDI interface 30. Main melody data representative of the input main melody are written into the music composing data storage section 16B. Alternatively, the main melody may be input by loading music piece data recorded on a storage medium installed in the external storage device 28, or downloading music piece data from the server computer 48 via the communication network 46 and communication interface 32.

At following step 122, a chord progression of the main melody is detected on the basis of the main melody data stored in the music composing data storage section 16B, and then chord progression data indicative of the detected chord progression is written into the music composing data storage section 16B. The technique for analyzing the melody and detecting the chord progression is well known and will not be described here. Note that a chord progression suiting the main melody may be manually entered by the user in stead of analyzing the melody and detecting the chord progression from the analyzed melody. In another alternative, several chord progression candidates may be presented through analyzation of the main melody so that the user can select any one of the chord progression candidates.

At step 124, a musical phrase setup of the main melody is detected on the basis of the chord progression data stored in the music composing data storage section 16B, and musical phrase setup data representative of the detected musical phrase setup are written into the music composing data storage section 16B. The musical phrase setup detection may be made by regarding the leading or first musical phrase of the main melody as the A-type phrase, regarding each musical phrase having a chord progression similar to that of the leading A-type phrase as the A'-type phrase, regarding each musical phrase having a different chord progression from the leading A-type phrase as the B-type phrase, regarding each musical phrase having a different chord progression from the A-type and B-type phrases as the C-type phrase, and so on. The musical phrase setup can also be detected by comparing the input main melody to a predetermined reference melody. In stead of detecting the musical phrase setup through analyzation of the chord progression and melody, the user may manually enter the musical phrase setup of the main melody. In another alternative, several musical phrase setup candidates may be presented through analyzation of the chord progression and main melody so that the user can select any one of the phrase setup candidates.

At step 126, a scale is detected on the basis of the main melody data stored in the music composing data storage section 16B, and then scale data representative of the detected scale is written into the storage section 16B. Where the scale of a musical key is used as the scale, only the musical key has to be detected. The technique for detecting the musical key is well known and will not be described here. Where an AVNS is used as the scale, the AVNS is detected on the basis of the musical key and chords using an AVNS detection technique. Such an AVNS detection technique has already been proposed by the same assignee of the instant application, for example, in Japanese Patent Application No. HEI-10-166302. The same assignee of the instant application has proposed another AVNS detection technique which is arranged to detect the AVNS by referring to chords preceding and succeeding the chord in question (e.g., Japanese Patent Application No. HEI-11-247135). Alternatively, the user may manually enter the musical key and AVNS, or several candidates of the musical key and AVNS may be presented through analyzation of the chord progression and melody so that the user can select respective desired ones of the musical key and AVNS candidates.

After step 126, the routine of FIG. 6 proceeds to step 96 of FIG. 5, in order to carry out operations similar to those at and after step 96 of FIG. 5. The chord progression data stored in the music composing data storage section 16B is used in the pitch impartment operation at step 110. The scale data stored in the storage section 16B are used in the pitch impartment operation at step 114. The musical phrase setup data stored in the storage section 16B are referred to in the pitch impartment operations at step 110 and 114, and if the musical phrase sequence is, for example, "A-type phrase—B-type phrase—A-type phrase—A'-type phrase", the auxiliary melody is created in accordance with the musical phrase sequence.

The musical composition process of FIG. 6 affords the same advantageous results as stated earlier in relation to the musical composition routine of FIG. 2.

Figure 7:
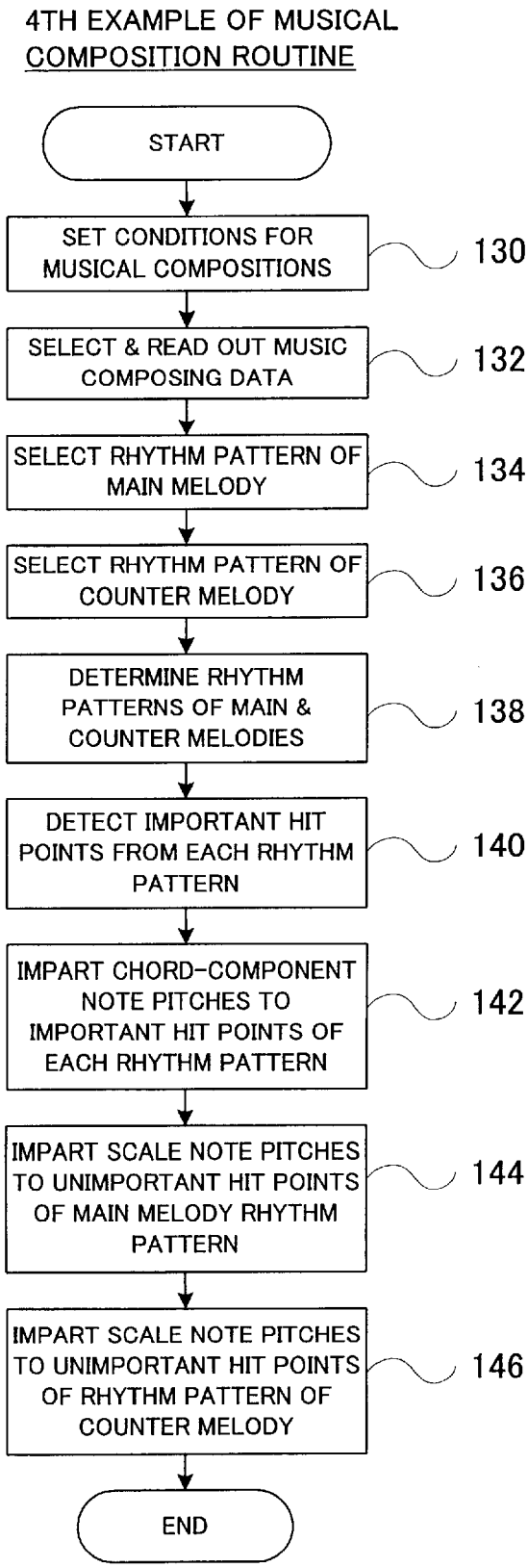
FIG. 7 is a flow chart showing a fourth example of the musical composition routine.
Figure 8:
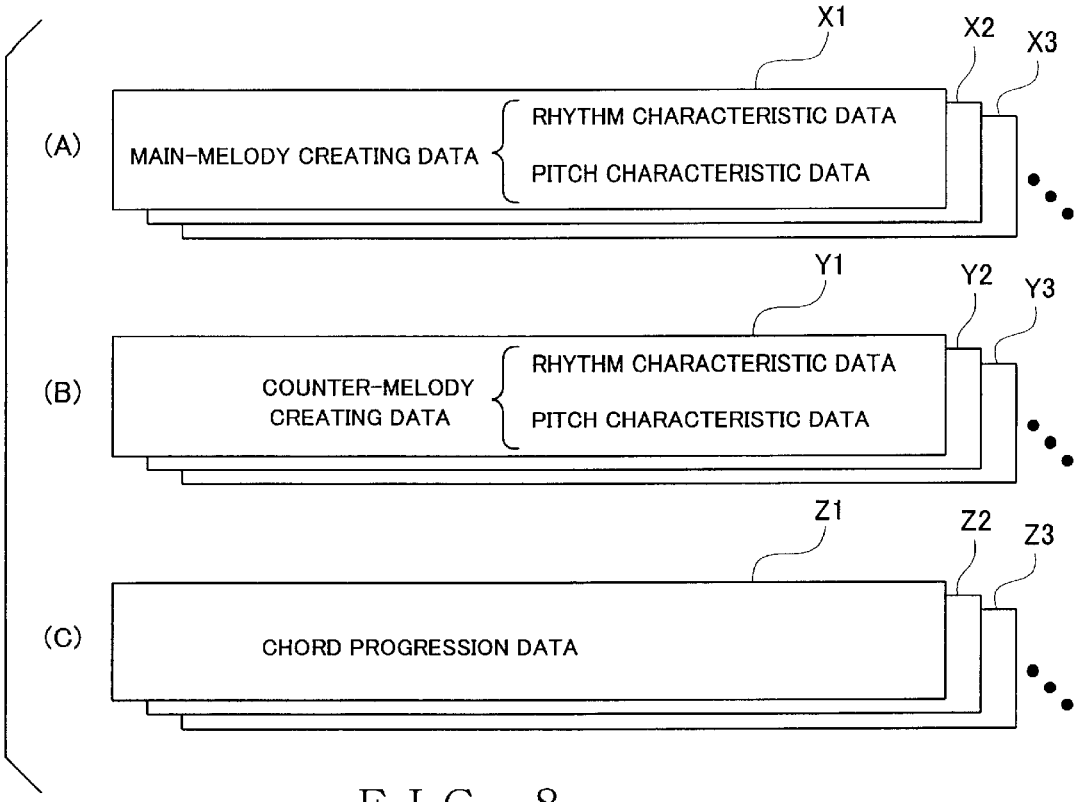
FIG. 8 is a diagram showing an exemplary storage format in which main melody creating data, counter melody creating data and chord progression data are stored.
Figure 10:
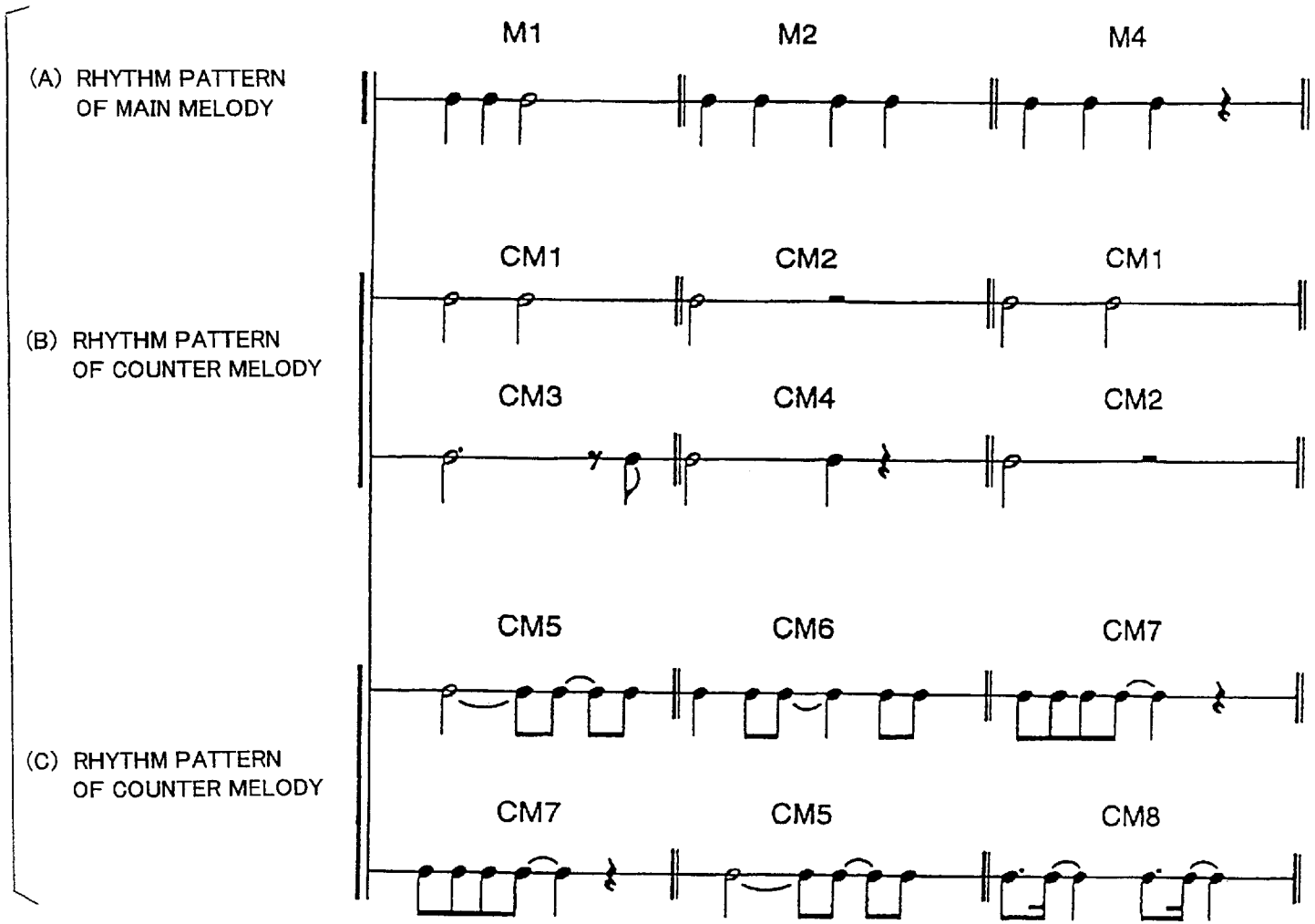
FIG. 10 is a diagram showing examples of rhythm patterns of the counter melody corresponding to rhythm patterns of the main melody.

FIG. 7 is a flow chart showing a fourth example of the musical composition routine. In this example, a main melody and a counter melody are created. Here, in the database, main-melody creating data sets X1, X2, X3, counter-melody creating data set Y1, Y2, Y3, . . . chord progression data sets Z1, Z2, Z3, . . . are stored along with a multiplicity of rhythm patters, as shown in sections (A), (B) and (C), respectively, of FIG. 8. FIG. 10 shows examples of rhythm patterns M1, CM1, etc. The data in sections (A), (B) and (C) of FIG. 8 are data corresponding to musical conditions, such as musical genre, musical key, musical time, tempo, etc., which are stored in data sets. Namely, a first data set X1—Y1—Z1, second data set X2—Y2—Z2, third data set X3—Y3—Z3, . . . are stored in the database in corresponding relation to first, second, third, . . . musical condition groups.

The main-melody creating data such as the data X1 and the counter-melody creating data set such as the data Y1 both include rhythm characteristic data and pitch characteristic data. FIG. 9A shows an example of the rhythm characteristic data related to main-melody creating rhythm patterns, and this example of the rhythm characteristic data indicates the numbers of the hit points (rhythm hit points) in the respective main-melody creating rhythm patterns M1 to M6, and presence/absence of syncopation in the main-melody creating rhythm patterns. When necessary, any one of the main-melody creating rhythm patterns is selected which includes rhythm characteristic data matching with the rhythm characteristic data of selected main-melody creating data (e.g., the data Xl). In case there are two or more rhythm patterns which include rhythm characteristic data matching with the rhythm characteristic data of the selected main-melody creating data, any one of the two or more rhythm patterns is selected randomly or in accordance with a user instruction. FIG. 9B shows an example of the rhythm characteristic data related to counter-melody creating rhythm patterns, and this example of the rhythm characteristic data indicates the main-melody creating rhythm patterns corresponding to the counter-melody creating rhythm patterns, the numbers of the hit points in the respective counter-melody creating rhythm patterns and presence/absence of syncopation in the counter-melody creating rhythm patterns. When necessary, any one of the counter-melody creating rhythm patterns is selected which includes rhythm characteristic data matching with the rhythm characteristic data of selected counter-melody creating data (e.g., the data Y1) and which corresponds to the main-melody creating rhythm pattern selected in the above-mentioned manner. Because the counter-melody creating rhythm patterns are stored in association with (in corresponding relation to) the main-melody creating rhythm patterns, one of the counter-melody creating rhythm patterns which well matches with or suits the selected main-melody creating rhythm pattern can be automatically selected. In case there are two or more counter-melody creating rhythm patterns suiting the selected main-melody creating rhythm pattern, any one of the two or more counter-melody creating rhythm patterns is selected randomly or in accordance with a user instruction.

As an example, "Small", "Medium" and "Great" regarding the number of the hit points in FIGS. 9A and 9B are defined as follows in a situation where the shortest note is an eighth note.

(a) If only one or two hit points exist within a measure, the number of hit points is "small", (b) if three to five hit points exist within a measure, the number of the hit points is "medium", and (c) if six to eight hit points exist within a measure, the number of the hit points is "great".

Section (A) of FIG. 10 shows main-melody creating rhythm patterns M1, M2 and M4, from among rhythm patterns M1 to M6 of FIG. 9A, where the number of the hit points is "small" and no syncopation is present. Section (B) of FIG. 10 shows counter-melody creating rhythm patterns CM1 to CM4, from among rhythm patterns CM1–CM8 of FIG. 9B, where the number of the hit points is "small" and no syncopation is present, in corresponding relation to the main-melody creating rhythm patterns M1, M2 and M4 in section (A) of FIG. 10 on the basis of the correspondency shown in FIG. 9B. Further, section (C) of FIG. 10 shows counter-melody creating rhythm patterns CM5 to CM8, from among rhythm patterns CM1–CM8 of FIG. 9B, where the number of the hit points is "medium" and syncopation is present, in corresponding relation to the main-melody creating rhythm patterns M1, M2 and M4 in section (A) of FIG. 10 on the basis of the correspondency shown in FIG. 9B.

As clear from the illustrated example of FIG. 10, the counter-melody creating rhythm patterns CM1, CM3, CM5 and CM7 correspond to (are grouped in relation to) the main-melody creating rhythm pattern M1, the counter-melody creating rhythm patterns CM2, CM4, CM5 and CM6 correspond to (are grouped in relation to) the main-melody creating rhythm pattern M2, and the counter-melody creating rhythm patterns CM1, CM2, CM7 and CM8 correspond to (are grouped in relation to) the main-melody creating rhythm pattern M4. In each set of the main-melody creating rhythm pattern and corresponding counter-melody creating rhythm patterns, the hit points of the main-melody creating rhythm pattern and the hit points of the counter-melody creating rhythm patterns are set in such a manner that they cooperate with or complement each other. This arrangement is one of the reasons why the instant embodiment can create a counter melody having appropriate rhythmic suitability to the main melody.

Each of the pitch characteristic data in the data shown in section (A) of FIG. 8, represents extent of pitch leaps, skeleton pitches (i.e., pitches at the important hit points), etc. of the main melody. Similarly, each of the pitch characteristic data in the data shown in section (B) of FIG. 8, represents en extent of pitch leaps, skeleton pitches, etc. of the counter melody. The pitch characteristic data shown in sections (A) and (B) of FIG. 8 may include data indicative of pitches at the unimportant hit points. Further, each of the chord progression data in section (C) of FIG. 8 represents the chord progression of the main melody and includes AVNS data for each of the chords. An example of the chord progression of the main melody is shown in section (C) of FIG. 11.

Referring FIG. 7, musical conditions, such as a musical genre, musical key, musical time and tempo are entered, at step 130, via the switch operator unit 38 and written into the musical condition storage section 16A. Then, the process moves on to step 132, where music composing data satisfying the musical conditions set at step 130 are selectively read out from the database and then written into the music composing data storage section 16B. As an example, the set of the data X1, Y1 and Z1 of FIG. 8 are read out together and written into the music composing data storage section 16B.

At next step 134 of FIG. 7, one or more of the main-melody creating rhythm patterns are selected which include rhythm characteristic data matching with the rhythm characteristic data of the main melody stored in the music composing data storage section 16B. For example, when such musical conditions that the number of the hit points is "small" and no syncopation is present are stored, as main-melody creating rhythm characteristic data, in the storage section 16B, the main-melody creating rhythm patterns M1, M2 and M4 provided with the rhythm characteristic data are selected.

Then, at step 136, one or more of the counter-melody creating rhythm patterns are selected which include rhythm characteristic data matching with the rhythm characteristic data of the main melody stored in the music composing data storage section 16B and which correspond to the main-melody creating rhythm patterns selected at step 134. For example, when such musical conditions that the number of the hit points is "medium" and no syncopation is present are stored, as counter-melody creating rhythm characteristic data, in the storage section 16B, the counter-melody creating rhythm patterns CM5 to CM8 are selected which are provided with the rhythm characteristic data and correspond to the main-melody creating rhythm patterns M1, M2 and M4 selected at step 134.

Then, at step 138, main melody and counter melody rhythm patterns are determined on the basis of the rhythm patterns selected at steps 134 and 136. For example, when a melody of four measures is to be created, the main-melody creating rhythm patterns M1, M2 and M4 are selected and randomly arranged into a pattern sequence of "M1, M1, M2, M4" as shown in section (A) of FIG. 11. Also, the counter-melody creating rhythm patterns CM5, CM6 and CM7 are selected and randomly arranged into a pattern sequence of "CM5, CM7, CM6, CM7" in correspondence to the "M1, M1, M2, M4" sequence as shown in section (B) of FIG. 11. In stead of the random arrangement, the rhythm patterns as shown in sections (A) and (B) of FIG. 11 may be visually displayed on the display device 40 so that the user can select the arrangement of the rhythm patterns. In this way, user's desire can be effectively reflected in the main and counter melodies. Then, pattern data representative of the rhythm patterns determined at step 138 (e.g., rhythm patterns as shown in sections (A) and (B) of FIG. 11) is read out from the database and written into a predetermined storage area of the RAM 16.

At step 140, detection is made of the important hit points from each of the rhythm pattern of the main and counter melodies. In the illustrated examples in sections (A) and (B) of FIG. 11, notes circled numerical values 1, 2, 3, . . . represent such important hit points.

At step 142, skeleton pitches are imparted to the detected important hit points in the main melody rhythm patterns, in accordance with the main melody's pitch characteristic data and chord progression data stored in the music composing data storage section 16B. In addition, skeleton pitches are imparted to the detected important hit points in the counter melody rhythm patterns, in accordance with the counter melody's pitch characteristic data and chord progression data stored in the music composing data storage section 16B.

When pitches are to be imparted to the important hit points in the rhythm patterns of the main and auxiliary melodies, the important hit points in each chord zone in the rhythm patterns may be imparted randomly with pitches of a plurality of chord-component notes, with reference to the chord progression data stored in the music composing data storage section 16B. In this case, the following rules are applied as sixth musical rules pertaining to a pitch progression of the main melody or counter melody:

(a) a dominant motion should be made if considered as possible by reference to the chord progression; and (b) a same note should not occur more than twice in succession.

Further, the following rules are applied as seventh musical rules for achieving appropriate compatibility between the main and counter melodies:

(a) skeleton pitches the counter melody should be generated with respect to the skeleton pitches of the main melody, with reference to predetermined pitch conditions as will be described below; and (b) pitch intervals between the main and counter melodies should be limited to within eight degrees. If, in this case, the sixth and seventh musical rules conflict with each other, the seventh musical rules are given a higher priority.

The above-mentioned predetermined pitch conditions are set such that the lower-pitch melody (i.e., one of the main and counter melodies having lower pitches than the other melody) and the higher-pitch melody have the following pitch relationship:

| Lower-Pitch Melody | Higher-Pitch Melody |
|---|---|
| 1st degree (C) | 1st degree (C) (same as the note of the lower-pitch melody), 3rd degree above the note of the lower-pitch melody (E), 5th degree above (G), 8th degree above (C) |

-continued

| Lower-Pitch Melody | Higher-Pitch Melody |
|---|---|
| 3rd (E) | 5th degree above (G), 8th degree above (C) |
| 5th (G) | 3rd degree above (E) |

Here, alphabetical letters in parentheses represent notes or pitches when the chord is the C major. Which of the main and counter melodies should be set as the lower-pitch melody may be determined arbitrarily by the user at step 130, or may be designated by the pitch characteristic data as shown in section (A) or (B) of FIG. 8.

Namely, if the main melody is set as the lower-pitch melody and when the pitch of the main melody is "C", the pitch of the counter melody as the higher-pitch melody is set to any one of the first degree (C) that is the same as the lower-pitch melody note, third degrees above the lower-pitch melody note (E), fifth degree above the lower-pitch melody note (G) and eighth above the lower-pitch melody note (C), by random selection or user's selection. Further, if the main melody is set as the higher-pitch melody and when the pitch of the main melody is "C", the pitch of the counter melody as the lower-pitch melody is set to any one of the first degree below the higher-pitch melody note (C) and 3rd degree below the higher-pitch melody note (E). Because it is already known which one of the notes of a chord each skeleton pitch of the main melody is, optimum skeleton pitches of the counter melody can be generated.

At step 144, scale pitches are imparted randomly to the unimportant hit points (i.e., hit points other than the important hit points) in the rhythm patterns of the main melody. As the scale pitches, there may be used a plurality of notes of the scale of the musical key indicated by the musical key data stored in the musical condition storage section 16A or a plurality of scale notes of the chord-specific available note scale (AVNS) stored in the music composing data storage section 16B. In this case, there is applied an eighth musical rule that a same note should not occur more than twice in succession.

Then, at step 146, scale pitches are imparted randomly to the unimportant hit points in the rhythm patterns of the counter melody, using the key scale or AVNS in a similar manner to step 146. Further, the following rules are applied as ninth musical rules for allowing the pitches at the unimportant points of the counter melody to appropriately match with or suit the pitches at the unimportant points of the main melody:

(a) pitch intervals between the main and counter melodies should be limited to within eight degrees;

(b) the pitches of the counter melody should not intersect with those of the main melody; and (c) parallel relationship of perfect fifth degree or perfect third degree to the main melody should be inhibited.

Sections (C) and (D) of FIG. 11 show examples of the rhythm patterns shown in sections (A) and (B) of FIG. 11 where pitches are imparted to the important and unimportant hit points through the operations of steps 142 to 146. Main melody data and counter melody data, representative of the thus pitch-imparted main melody data and counter melody, are stored as music piece data into the music piece data storage section 16C. After that, the music composition routine of FIG. 7 is brought to an end.

In the music composition routine of FIG. 7, the main-melody creating rhythm patterns and counter-melody creating rhythm patterns are stored in association with each other, and selected ones of the creating rhythm patterns are read out to create the main and counter melodies, as described above. Thus, the created counter melody can have appropriate rhythmic suitability to the created main melody. Further, because pitches of chord-component notes are imparted to the important points of each of the rhythm patterns while pitches of scale notes are imparted to the unimportant points of each of the rhythm patterns, it is possible to produce main and counter melodies rich in musical characteristics.

Further, in the music composition routine of FIG. 7, the operations related to the rhythm pattern selection and pitch generation may be carried out taking into account overall setup information of the entire music piece to be created. Namely, as described earlier in relation to the description about FIGS. 2 to 4, the entire music piece to be created is divided into musical phrases (or melody blocks), so that a same rhythm pattern is selected and a same pitch progression is generated for musical phrases of a same type while similar rhythm patterns are selected and similar pitch progression is generated for musical phrases of similar types. Further, for such a musical phrase commonly called a "bridge" (e.g., the above-mentioned B-type musical phrase), a livening-up rhythm pattern is selected and a livening-up pitch progression is generated.

Whereas the counter melody created by the music composition process of FIG. 7 has been described as comprising only one part, counter melodies of two or more parts can be readily created using the music composition process of FIG. 7.

The music composition process of FIG. 7 can also be applied to a melody creation scheme which develops a full music piece in response to a motif melody of about two measures given to the beginning of the music piece. For example, when a motif melody is to be automatically created on the basis of a chord progression or the like, a motif melody is first created automatically, and then a main melody portion following the motif melody and a counter melody are created on the basis of a set of rhythm patterns selected from the database in a similar manner to the foregoing.

As another example, the music composition process of FIG. 7 may be applied to a case where a rhythm pattern of a motif melody is entered by the user tapping or making other actions, a motif melody is created by imparting pitches to the rhythm pattern of the motif melody automatically or through manual input by the user, the motif melody is developed into a full music piece to create a main melody, and then a counter melody corresponding to the main melody is automatically created. In this case, the music composition process presents several counter-melody creating rhythm patterns to the user to allow the user to select a desired one of the rhythm patterns, and automatically creates a counter melody on the basis of the selected rhythm pattern in a similar manner to the foregoing. For the rhythm pattern selection, rhythm characteristics may be detected from the motif melody so that a rhythm pattern corresponding to the detected rhythm characteristics is searched for, retrieved from the database and then displayed as a rhythm pattern candidate on the display device 40.

As still another example, the music composition process of FIG. 7 may be applied to a case where the user enters a motif melody using the keyboard 36 or the like, the motif melody is developed into a full music piece to create a main melody, and then a counter melody corresponding to the main melody is automatically created. In this case, the music composition process detects, from the motif melody, a rhythm pattern and pitches at the important and unimportant hit points of the rhythm pattern. Then, the process determines a rhythm pattern of a counter melody on the basis of the detected rhythm pattern, and imparts, to the important and unimportant hit points of the counter melody rhythm pattern, pitches that appropriately suit the detected pitches at the important and unimportant hit points of the rhythm pattern of the motif melody, in a similar manner to steps 142 and 146 above.

The present invention should never be construed as being limited to the above-described embodiments, and may be practiced in various modified forms. For example, the following modifications of the present invention are possible.

(1) In the musical composition process of FIG. 2, 5 or 6, a counter melody may be created in place of the auxiliary melody. Conversely, in the musical composition process of FIG. 7, an auxiliary melody may be created in place of the counter melody.

(2) To designate a musical phrase setup, designation like "four intro measures, four A-type melody measures, two B-type melody measures, two fill-in measures and four ending measures" may be used, in place of designation of a sequence or arrangement of musical phrases and the number of measures per musical phrase.

(3) It is not necessary to allocate notes to all of the important hit points and/or unimportant hit points; that is, there may be some hit points to which notes are not allocated. Further, some of the unimportant hit points may be set to timing other than tone generation timing of the rhythm pattern. Furthermore, the note selection in the present invention is not limited to the above-described random or manual selection, and the notes may be selected automatically in accordance with a predetermined sequence.

(4) The present invention can be implemented by a combination of a personal computer and application software, rather than by an electronic musical instrument. In such a case, the application software may be recorded on and then supplied from a storage medium, such as a magnetic disk, magneto-optical disk or semiconductor memory, to the personal computer, or the application software may be supplied via a communication network.

(5) The present invention may be applied to creation of music piece data for use in a karaoke apparatus, player piano, electronic game apparatus, portable communication terminal such as a cellular phone, etc. Where the present invention is applied to creation of music piece data for use in a portable communication terminal, at least one or more of the inventive functions may be assigned to a server, in place of all the inventive functions being assigned to the portable communication terminal alone. For example, musical conditions may be designated via the portable communication terminal and transmitted to the server so that the server can create main and auxiliary (or counter) melodies and then deliver the thus-created melodies to the portable communication terminal. In an alternative, a main melody may be created by the portable communication terminal and transmitted to the server so that the server can create an auxiliary (or counter) melody corresponding to the main melody and then deliver the melodies to the portable communication terminal. In this way, the main and auxiliary (or counter) melodies delivered to the portable communication terminal can be used as an incoming-call alerting melody, BGM during a telephone conversation, alarm sound, etc. Also, the main and auxiliary (or counter) melodies delivered to the portable communication terminal can be attached to an e-mail to be sent to another portable communication terminal.

(6) The present invention can be applied not only to electronic musical instruments containing a tone generator device, automatic performance device, etc., but also to other types of electronic musical instruments having a keyboard, tone generator device, automatic performance device, etc. connected with each other via a MIDI or communication facilities such as a communication network.

(7) It should also be appreciated that the music piece data, such as data of a melody, chord etc., may be in any desired format other than the "event plus relative time" format where the time of occurrence of each performance event is represented by a time length from the immediately preceding event, such as: the "event plus absolute time" format where the time of occurrence of each performance event is represented by an absolute time within the music piece or a measure thereof; the "pitch (rest) plus note length" format where contents of the music piece are represented by pitches and lengths of notes, rests and lengths of the rests; or the "solid" format where a memory region is reserved for each minimum resolution of a performance and each performance event is stored in one of the memory regions that corresponds to the time of occurrence of the performance event.

(8) Where the music piece data are created for a plurality of channels, the data for the channels may be recorded mixedly, or separately on different recording tracks on a channel-by-channel basis.

(9) Where the music piece data are to be recorded, they may be recorded time-serially in successive regions of memory, or may be recorded in dispersed regions of memory but managed as successive data.

In summary, the present invention having been described so far is characterized in that pitches of chord-component notes are imparted to the important points of a rhythm pattern to be used for creating, in connection with a first melody, a second melody while pitches of scale notes are imparted to the unimportant points of the rhythm pattern of the second melody. Hence, with the present invention, it is possible to create, as the second melody, an auxiliary or counter melody rich in musical characteristics.

The present invention is also characterized in that the rhythm pattern to be used for creating the second melody is determined on the basis of a rhythm pattern to be used for creating the first melody or a rhythm pattern detected from the first melody and in that the rhythm patterns for creating the first and second melodies are read out in corresponding relation to each other. With such arrangements of the present invention, it is possible to create, as the second melody, an auxiliary or counter melody appropriately suiting the first or main melody.

What is claimed is:

1. An automatic musical composition method comprising:

a first step of supplying a rhythm pattern indicative of timing of respective hit points of a plurality of tones;

a second step of discriminating between predetermined important hit points and unimportant hit points other than the important hit points in the rhythm pattern supplied by said first step;

a third step of supplying at least a chord progression and scale information; and a fourth step of allocating, to each of the important hit points discriminated by said second step, any one of chord-component notes of chords specified by the chord progression supplied by said third step and allocating, to each of the unimportant hit points, any one of scale notes corresponding to the scale information, wherein a melody is created on the basis of the notes allocated to individual ones of the hit points by said fourth step.

2. An automatic musical composition method as claimed in claim 1 which is arranged to create, on the basis of a first melody, a second melody, and wherein said first step supplies a rhythm pattern that suits a rhythm of said first melody, said third step supplies a chord progression and scale information of said first melody, and said second melody is created on the basis of the notes allocated to individual ones of the hit points by said fourth step.

3. An automatic musical composition method as claimed in claim 2 wherein said first step includes a step of supplying a rhythm pattern of said first melody and a step of creating a rhythm pattern for said second melody on the basis of the supplied rhythm pattern of said first melody, and wherein the created rhythm pattern for said second melody is the rhythm pattern to be supplied by said first step.

4. An automatic musical composition method as claimed in claim 2 wherein said first step includes a step of extracting a rhythm pattern of said first melody from data representative of said first melody and a step of creating a rhythm pattern for said second melody on the basis of the extracted rhythm pattern of said first melody, and wherein the created rhythm pattern for said second melody is the rhythm pattern to be supplied by said first step.

5. An automatic musical composition method as claimed in claim 2 wherein said first step includes a step of setting whether or not a rhythm of said second melody should be the same as a rhythm of said first melody, and a step of, when the rhythm of said second melody has been set to be the same as the rhythm of said first melody, supplying a same rhythm pattern as the rhythm of said first melody as the rhythm of said second melody but, when the rhythm of said second melody has been set to be not the same as the rhythm of said first melody, supplying a partially-modified version of the rhythm pattern of said first melody as the rhythm of said second melody.

6. An automatic musical composition method as claimed in claim 2 wherein said third step includes a step of detecting a chord progression of said first melody from said first melody and supplies the detected chord progression.

7. An automatic musical composition method as claimed in claim 2 wherein said third step supplies the chord progression of said first melody on the basis of a prestored chord progression template of said first melody.

8. An automatic musical composition method as claimed in claim 2 wherein said third step supplies, as the scale information, chord information indicative of each of the chords in the chord progression of said first melody, and wherein said fourth step selects the scale notes to be allocated to the unimportant hit points from among notes of an available note scale corresponding to the chord information supplied as the scale information.

9. An automatic musical composition method as claimed in claim 2 wherein said first melody is a main melody and said second melody is an auxiliary melody or an counter melody.

10. An automatic musical composition method as claimed in claim 1 wherein the important hit points each represent a downbeat or a hit point near the downbeat.

11. An automatic musical composition method as claimed in claim 1 wherein said fourth step allocates any one of the chord-component notes to a specific one of the important hit points or allocates any one of the scale notes to a specific one of the unimportant hit points, by making a random note selection.

12. An automatic musical composition method as claimed in claim 1 wherein said fourth step allocates any one of the chord-component notes to a specific one of the important hit points or allocates any one of the scale notes to a specific one of the unimportant hit points, by referring to a predetermined rule.

13. An automatic musical composition method as claimed in claim 1 wherein said fourth step allocates any one of the chord-component notes to a specific one of the important hit points or allocates any one of the scale notes to a specific one of the unimportant hit points, by making a note selection from among note candidates in response to manual operation by a user.

14. An automatic musical composition method as claimed in claim 1 wherein the scale information includes musical key information designating a key scale, and the scale notes corresponding to the scale information are scale notes in the key scale designated by the musical key information.

15. An automatic musical composition method as claimed in claim 1 wherein the scale information is information defined by each of the chords in the chord progression, and the scale notes corresponding to the scale information are scale notes in a chord scale defined by each of the chords in the chord progression.

16. An automatic musical composition method as claimed in claim 1 which further comprises a step of adjusting a pitch or hit point timing of the notes allocated to each of the hit points.

17. An automatic musical composition method as claimed in claim 1 wherein said fourth step does not allocate any note to one or some of the hit points in a certain situation.

18. An automatic musical composition method comprising:

a first step of supplying a first rhythm pattern indicative of timing of respective hit points of a plurality of tones for a first melody to be created and a second rhythm pattern indicative of timing of respective hit points of a plurality of tones for a second melody to be created;

a second step of discriminating between predetermined important hit points and unimportant hit points other than the important hit points in said first rhythm pattern supplied by said first step, and discriminating between predetermined important hit points and unimportant hit points other than the important hit points in said second rhythm pattern supplied by said first step;

a third step of supplying at least a chord progression and scale information; and a fourth step of allocating a note to each of the important hit points discriminated in said first rhythm pattern, taking into account at least chords specified by the chord progression supplied by said third step, and allocating, to each of the unimportant hit points in said first rhythm pattern, any one of scale notes corresponding to the scale information supplied by said third step; and a fifth step of allocating, to each of the important hit points discriminated in said second rhythm pattern by said second step, any one of the chord-component notes of the chords specified by the chord progression supplied by said third step, and allocating, to each of the unimportant hit points in said second rhythm pattern, any one of the scale notes corresponding to the scale information;

wherein a first melody is created on the basis of the notes allocated to individual ones of the hit points by said fourth step, and a second melody is created on the basis of the notes allocated to individual ones of the hit points by said fifth step.

19. An automatic musical composition method as claimed in claim 18 wherein said third step includes a step of detecting a chord progression of said first melody from said first melody and supplies the detected chord progression.

20. An automatic musical composition method as claimed in claim 18 wherein said third step supplies the chord progression of said first melody on the basis of a prestored chord progression template of said first melody.

21. An automatic musical composition method as claimed in claim 18 wherein said third step supplies, as the scale information, chord information indicative of each of the chords in the chord progression of said first melody, and wherein said fourth step selects the scale notes to be allocated to the unimportant hit points from among notes of an available note scale note corresponding to the chord information supplied as the scale information.

22. An automatic musical composition method as claimed in claim 18 wherein the important hit points each represent a downbeat or a hit point near the downbeat.

23. An automatic musical composition method as claimed in claim 18 wherein the scale information represents a key scale of said first melody, and the scale notes corresponding to the scale information are scale notes in the key scale of said first melody.

24. An automatic musical composition method as claimed in claim 18 wherein said first step includes a step of reading out, from among rhythm patterns prestored in a memory, a rhythm pattern to be used as one of said first rhythm pattern and said second rhythm pattern and a step of creating, on the basis of the read-out rhythm pattern, a rhythm pattern to be used as other of said first rhythm pattern and said second rhythm pattern.

25. An automatic musical composition method as claimed in claim 18 wherein said first step reads out said first rhythm pattern and said second rhythm pattern from among rhythm patterns prestored in a memory.

26. An automatic musical composition method as claimed in claim 18 wherein said first melody is a main melody and said second melody is an auxiliary melody or a counter melody.

27. An automatic musical composition method as claimed in claim 18 which further comprises a step of supplying pitch characteristic data for creating said first melody, and wherein said fourth step allocates a note to each of the important hit points discriminated in said first rhythm pattern, taking into account the chords specified by the chord progression supplied by said third step and the pitch characteristic data.

28. An automatic musical composition method as claimed in claim 18 wherein said fourth step or said fifth step allocates a note to a specific one of the important or unimportant hit points, by making a random note selection.

29. An automatic musical composition method as claimed in claim 18 wherein said fourth step or said fifth step allocates a note to a specific one of the important or unimportant hit points, by referring to a predetermined rule.

30. An automatic musical composition method as claimed in claim 18 wherein said fourth step or said fifth step allocates a note to a specific one of the important or unimportant hit points, by making a note selection from among note candidates in response to manual operation by a user.

31. An automatic musical composition apparatus comprising:

a rhythm pattern supply section that supplies a rhythm pattern indicative of timing of respective hit points of a plurality of tones;

a discrimination section that discriminates between predetermined important hit points and unimportant hit points other than the important hit points in the rhythm pattern supplied by said rhythm pattern supply section;

an information supply section that supplies at least a chord progression and scale information; and a processing section that allocates, to each of the important hit points discriminated by said discrimination section, any one of chord-component notes of chords specified by the chord progression supplied by said rhythm pattern supply section and allocates, to each of the unimportant hit points, any one of scale notes corresponding to the scale information, wherein a melody is created on the basis of the notes allocated to individual ones of the hit points by said processing section.

32. A machine-readable storage medium containing a group of instructions to cause said machine to perform an automatic musical composition method, said automatic musical composition method comprising:

a first step of supplying a rhythm pattern indicative of respective hit points of a plurality of tones;

a second step of discriminating between predetermined important hit points and unimportant hit points other than the important hit points in the rhythm pattern supplied by said first step;

a third step of supplying at least a chord progression and scale information; and a fourth step of allocating, to each of the important hit points discriminated by said second step, any one of chord-component notes of chords specified by the chord progression supplied by said third step and allocating, to each of the unimportant hit points, any one of scale notes corresponding to the scale information, wherein a melody is created on the basis of the notes allocated to individual ones of the hit points by said fourth step.

33. An automatic musical composition apparatus comprising:

a rhythm pattern supply section that supplies a first rhythm pattern indicative of timing of respective hit points of a plurality of tones for a first melody to be created and a second rhythm pattern indicative of timing of respective hit points of a plurality of tones for a second melody to be created;

a discrimination section that discriminates between predetermined important hit points and unimportant hit points other than the important hit points in said first rhythm pattern supplied by said rhythm pattern supply section, and discriminates between predetermined important hit points and unimportant hit points other than the important hit points in said second rhythm pattern supplied by said rhythm pattern supply section;

an information supply section that supplies at least a chord progression and scale information; and a processing section that allocates a note to each of the important hit points discriminated in said first rhythm pattern, taking into account at least chords specified by the chord progression supplied by said information supply section, and allocates, to each of the unimportant hit points in said first rhythm pattern, any one of scale notes corresponding to the scale information supplied by said information supply section, and that allocates, to each of the important hit points discriminated in said second rhythm pattern, any one of the chord-component notes of the chords specified by the chord progression and allocates, to each of the unimportant hit points in said second rhythm pattern, any one of the scale notes corresponding to the scale information;

wherein a first melody is created on the basis of the notes allocated to individual ones of the hit points by said processing section, and a second melody is created on the basis of the notes allocated to individual ones of the hit points by said processing section.

34. A machine-readable storage medium containing a group of instructions to cause said machine to perform an automatic musical composition method, said automatic musical composition method comprising:

a first step of supplying a first rhythm pattern indicative of timing of respective hit points of a plurality of tones for a first melody to be created and a second rhythm pattern indicative of timing of respective hit points of a plurality of tones for a second melody to be created;

a second step of discriminating between predetermined important hit points and unimportant hit points other than the important hit points in said first rhythm pattern supplied by said first step, and discriminating between predetermined important hit points and unimportant hit points other than the important hit points in said second rhythm pattern supplied by said first step;

a third step of supplying at least a chord progression and scale information; and a fourth step of allocating a note to each of the important hit points discriminated in said first rhythm pattern, taking into account at least chords specified by the chord progression supplied by said third step, and allocating, to each of the unimportant hit points in said first rhythm pattern, any one of scale notes corresponding to the scale information supplied by said third step; and a fifth step of allocating, to each of the important hit points discriminated in said second rhythm pattern by said second step, any one of the chord-component notes of the chords specified by the chord progression supplied by said third step, and allocating, to each of the unimportant hit points in said second rhythm pattern, any one of the scale notes corresponding to the scale information;

wherein a first melody is created on the basis of the notes allocated to individual ones of the hit points by said fourth step, and a second melody is created on the basis of the notes allocated to individual ones of the hit points by said fifth step.

* * * * *